US012753947B2

(12) United States Patent
Jeon et al.

(10) Patent No.: US 12,753,947 B2
(45) Date of Patent: Oct. 6, 2026

(54) AIR CONDITIONER

(71) Applicant: SAMSUNG ELECTRONICS CO., LTD., Suwon-si (KR)

(72) Inventors: Mingu Jeon, Suwon-si (KR); Hyunho Kim, Suwon-si (KR); Wooyoung Park, Suwon-si (KR); Yongho Seo, Suwon-si (KR); Joonho Yoon, Suwon-si (KR); Changwoo Jung, Suwon-si (KR); Sunghyun Chun, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 420 days.

(21) Appl. No.: 18/377,002

(22) Filed: Oct. 5, 2023

(65) Prior Publication Data

US 2024/0191906 A1 Jun. 13, 2024

Related U.S. Application Data

(63) Continuation of application No. PCT/KR2023/013809, filed on Sep. 14, 2023.

(30) Foreign Application Priority Data

Dec. 13, 2022 (KR) ..... 10-2022-0174229

(51) Int. Cl.
*F24F 13/14* (2006.01)
*F24F 1/0011* (2019.01)
*F24F 1/0047* (2019.01)

(52) U.S. Cl.
CPC ..... *F24F 13/1486* (2013.01); *F24F 1/0011* (2013.01); *F24F 13/1426* (2013.01); *F24F 1/0047* (2019.02); *F24F 2013/1433* (2013.01)

(58) Field of Classification Search
CPC .. F24F 13/1486; F24F 1/0011; F24F 13/1426; F24F 1/0047; F24F 2013/1433
(Continued)

(56) References Cited

U.S. PATENT DOCUMENTS 10,619,648 B2 4/2020 Park et al.
10,895,401 B2 1/2021 Luo et al.
(Continued)

FOREIGN PATENT DOCUMENTS

CN 108050684 A 5/2018
EP 4 001 780 A1 5/2022
(Continued)

OTHER PUBLICATIONS

International Search Report dated Dec. 21, 2023 for International Application No. PCT/KR2023/013809.
(Continued)

*Primary Examiner* — Avinash A Savani
*Assistant Examiner* — Dana K Tighe
(74) *Attorney, Agent, or Firm* — STAAS & HALSEY LLP

(57) ABSTRACT

An air conditioner including a main body including a first side, a second side opposite to the first side, an outlet between the first and second side, and a guide protrusion on the outlet; and a blade to open and close the outlet, the blade including a blade body extending from the first side to the second side of the main body when the outlet is closed by the blade, and a guide rail on a top surface of the blade body facing the outlet. The blade is configured so that the blade body is rotatable relative to the outlet to adjust a direction of air from the outlet, and the guide rail is supported by the guide protrusion to be slidable to guide at least one of a
(Continued)

translational or a rotational movement of the blade body with respect to the main body during rotation of the blade body.

15 Claims, 19 Drawing Sheets

(58) Field of Classification Search
USPC ..... 454/233
See application file for complete search history.

(56) References Cited

U.S. PATENT DOCUMENTS

| | | | | |
|---|---|---|---|---|
| 2017/0067681 | A1* | 3/2017 | Kim | F24F 1/0047 |
| 2018/0313552 | A1* | 11/2018 | Lee | F24F 1/0011 |
| 2018/0313569 | A1* | 11/2018 | Moon | F24F 13/1426 |
| 2020/0263882 | A1* | 8/2020 | Kim | F24F 1/0014 |
| 2022/0260276 | A1 | 8/2022 | Kim et al. | |

FOREIGN PATENT DOCUMENTS

| | | |
|---|---|---|
| JP | 2008-122001 | 5/2008 |
| JP | 2012-102949 | 5/2012 |
| JP | 5375900 | 12/2013 |
| KR | 10-2018-0037514 | 4/2018 |
| KR | 10-2019-0027336 | 3/2019 |
| KR | 10-2019-0027338 | 3/2019 |
| KR | 10-2019-0032941 | 3/2019 |
| KR | 10-2019-0041808 | 4/2019 |
| KR | 10-2019-0051676 | 5/2019 |
| KR | 10-2019-0106075 | 9/2019 |
| KR | 10-2022-0020209 | 2/2022 |
| KR | 10-2022-0065338 | 5/2022 |
| KR | 10-2451312 | 10/2022 |
| KR | 10-2451313 | 10/2022 |
| KR | 10-2562546 | 8/2023 |
| WO | WO 2015/161738 A1 | 10/2015 |

OTHER PUBLICATIONS

Written Opinion of the International Searching Authority dated Dec. 21, 2023 for International Application No. PCT/KR2023/013809.

Extended European Search Report issued Oct. 2, 2025 for Application No. 23903685.8.

* cited by examiner

AIR CONDITIONER

CROSS-REFERENCE TO RELATED APPLICATIONS

This application is a continuation application, under 35 U.S.C. § 111 (a), of International Application No. PCT/KR2023/013809, filed on Sep. 14, 2023, which claims priority under 35 U.S.C. § 119 to Korean Patent Application No. 10-2022-0174229, filed on Dec. 13, 2022, in the Korea Intellectual Property Office, the disclosures of which are incorporated by reference herein in their entireties.

BACKGROUND

1. Field

The disclosure relates to an air conditioner having an improved structure.

2. Description of the Related Art

In general, air conditioners are apparatuses that use a cooling cycle to adjust temperature, humidity, airflow, etc., to a level suitable for human activity, while removing dust or other contaminates from the air.

An air conditioner may include an indoor unit, an outdoor unit, and a refrigerant pipe connecting the indoor unit and the outdoor unit and circulating a refrigerant.

An air conditioner may also be classified into a separate type, in which an indoor unit is placed indoors and an outdoor unit is placed outdoors, and an integrated type, in which both indoor and outdoor units are placed in a single housing.

SUMMARY

Aspects of embodiments of the disclosure will be set forth in part in the description which follows and, in part, will be apparent from the description, or may be learned by practice of the presented embodiments.

According to an embodiment of the disclosure, an air conditioner includes a main body including a first side, a second side opposite to the first side, an outlet between the first side and the second side, and a guide protrusion on the outlet; and a blade configured to open and close the outlet, the blade including a blade body extending from the first side to the second side of the main body when the outlet is closed by the blade, and a guide rail on a top surface of the blade body facing the outlet. The blade is configured so that the blade body is rotatable relative to the outlet to adjust a direction of flow of air discharged from the outlet, and the guide rail is supported by the guide protrusion so as to be slidable to guide at least one of a translational movement or a rotational movement of the blade body with respect to the main body during rotation of the blade body.

According to an embodiment of the disclosure, the air conditioner may further include a motor; and a linkage device configured to transmit a rotational force generated by the motor to the blade.

According to an embodiment of the disclosure, the linkage device may include a first link connected to the motor so that the first link may be rotatable, a second link connecting the first link and the blade, and a third link connecting the first link and the blade at a position closer to the motor than the second link, the third link having a length shorter than a length of the second link.

According to an embodiment of the disclosure, the guide rail may include a first section inclined downwardly along the direction of flow of the air and having a straight shape, and a second section extending from an upper portion of the first section and having a curved shape.

According to an embodiment of the disclosure, the blade body may be configured to perform a translational movement and a rotational movement with respect to the main body in response to the guide rail sliding with the guide protrusion in the first section.

According to an embodiment of the disclosure, the blade body may be configured to perform a rotational movement with respect to the main body in response to the guide rail sliding with the guide protrusion in the second section.

According to an embodiment of the disclosure, the blade may be configured to be movable between a first position in which the outlet may be closed and the guide protrusion may be disposed at an end of the first section of the guide rail, and a second position in which the outlet may be open and the guide protrusion may be disposed at an end of the second section of the guide rail.

According to an embodiment of the disclosure, the blade body may include a rear portion, and a front portion opposite to the rear portion. In response to the blade moving from the first position to a third position, in which the guide protrusion may be arranged to overlap the first section and the second section of the guide rail, the rear portion of the blade body may be configured to move forward.

According to an embodiment of the disclosure, the blade body may include a rear portion, and a front portion opposite to the rear portion. In response to the blade moving from a third position, in which the guide protrusion may be arranged to overlap the first section and the second section of the guide rail, to the second position, the blade body may be configured to rotate about the rear portion.

According to an embodiment of the disclosure, the second section of the guide rail may have a predetermined radius of curvature.

According to an embodiment of the disclosure, the second link and the third link may be configured to rotate in opposite directions to a rotation direction of the first link.

According to an embodiment of the disclosure, the motor may include a motor shaft. The first link may include a first end connected to the motor shaft, and a second end configured to rotate about the first end.

According to an embodiment of the disclosure, the blade may include a plurality of guide rails arranged along a longitudinal direction of the blade body.

According to an embodiment of the disclosure, the guide rail may be disposed more inwardly along the blade body than the linkage device.

According to an embodiment of the disclosure, the blade body may be configured to cover at least a portion of the first side and at least a portion of the second side when the outlet is closed by the blade.

BRIEF DESCRIPTION OF THE DRAWINGS

These and/or other aspects of the disclosure will become apparent and more readily appreciated from the following description of embodiments, taken in conjunction with the accompanying drawings of which.

DETAILED DESCRIPTION

Figure 1:
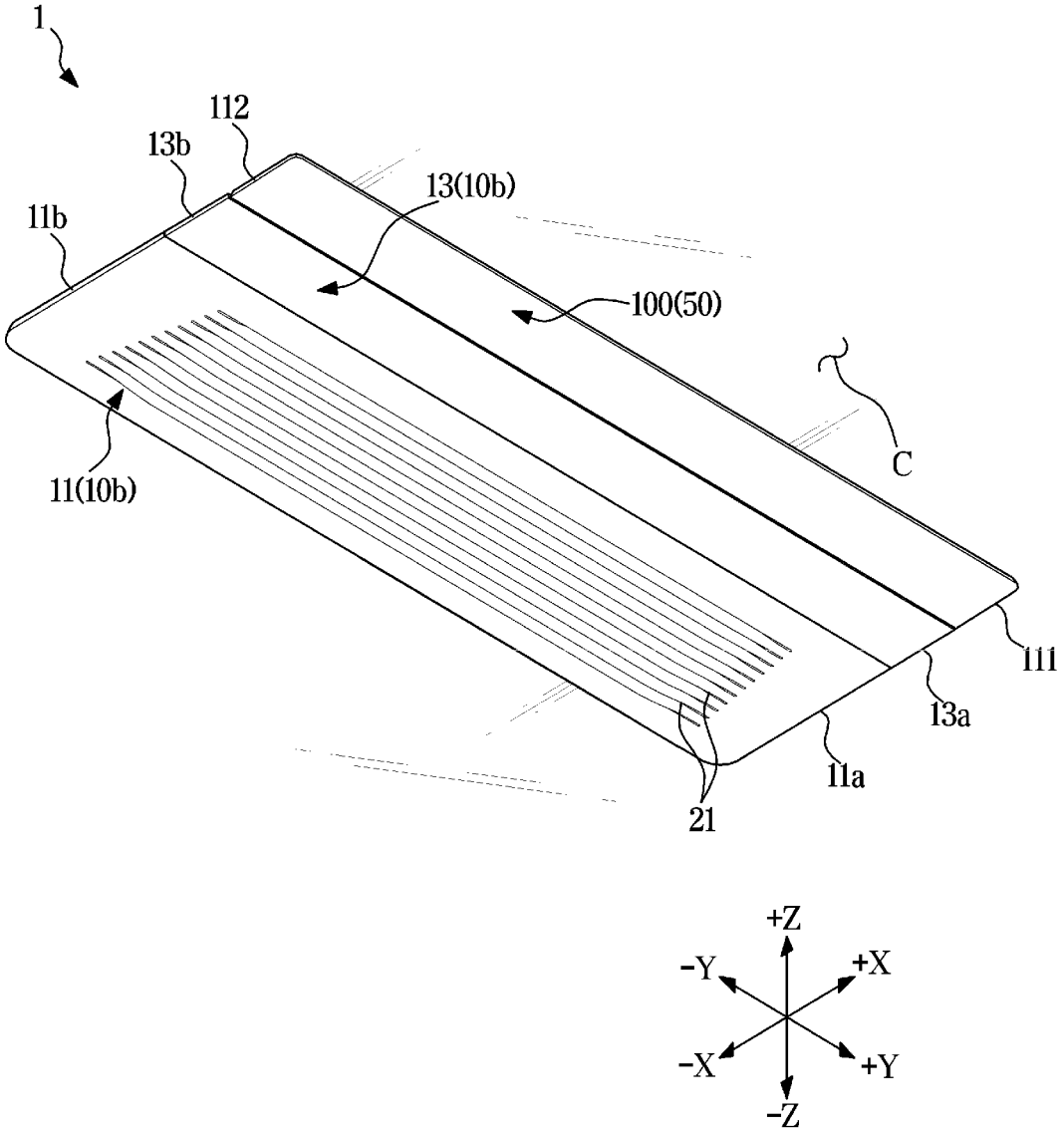
FIG. 1 is a perspective view illustrating an example of an exterior of an air conditioner according to an embodiment of the disclosure.

Embodiments described in the specification and configurations shown in the accompanying drawings are merely examples of the disclosure, and various modifications may replace the embodiments and the drawings of the disclosure.

Further, identical symbols or numbers in the drawings of the disclosure denote components or elements configured to perform substantially identical functions.

The singular form of a noun corresponding to an item may include one or more of the items, unless the relevant context clearly dictates otherwise.

As used herein, each of the phrases "A or B," "at least one of A and B," "at least one of A or B," "A, B or C," "at least one of A, B and C," and "at least one of A, B, or C" may include any of the items listed together in that phrase, or any possible combination thereof. For example, the phrase "at least one of a translational movement or a rotational movement of the blade body" includes any of the following: (a) translational movement, (b) rotational movement, and (c) translational movement and rotational movement.

The term "and/or" includes any and all combinations of one or more of the associated listed items.

Terms such as "first" or "second" may be used simply to distinguish one such component from another such component and do not qualify such components in any other respect (e.g., importance or order).

When a component (e.g., a first component) is referred to as "coupled" or "connected" to another component (e.g., a second component), with or without the terms "functionally" or "communicatively," it may refer to that the component may be connected to another component directly (e.g., wired), wirelessly, or through a third component.

Terms such as "include", "comprise" and/or "have" when used in this specification, are intended to specify the presence of stated features, integers, steps, operations, elements, and/or components, but do not preclude the presence or addition of one or more other features, integers, steps, operations, elements, components, and/or groups thereof.

When a component is referred to as being "connected," "coupled," "supported," or "in contact" with another component, this includes when the components are directly connected, coupled, supported, or in contact, as well as when they are indirectly connected, coupled, supported, or in contact through a third component.

When a component is referred to as being located "on" another component, this includes not only when a component abuts another component, but also when there is another component between the two components.

On the other hand, the terms "front and rear", "front", "rear", "up and down", "top", "bottom", "left and right", "left", "right", etc., used in the following description are defined based on the drawings, and the shape and position of each component are not limited by the terms.

For example, in the following description, it can be understood that front refers to a +X direction and rear refers to a −X direction. For example, in the following description, it can be understood that right refers to a +Y direction and left refers to a −Y direction. For example, in the following description, it can be understood that top refers to a +Z direction and bottom refers to a −Z direction.

For example, it can be understood that an outlet 22 is positioned in front of an inlet 21. However, it is not limited thereto and the definition of direction may vary depending on the geometry and/or position of a blade 100.

A refrigeration cycle constituting an air conditioner may include a compressor, a condenser, an expansion valve, and an evaporator. The refrigeration cycle may enable circulation in a series of processes including compression-condensation-expansion-evaporation, and supply air having heat exchanged with a refrigerant.

The compressor compresses and discharges refrigerant gas at high temperature and pressure, and the discharged refrigerant gas enters the condenser. The condenser condenses the compressed refrigerant into liquid and releases heat to the surroundings through the condensation process. The expansion valve expands the high temperature and high pressure liquid refrigerant condensed in the condenser to a low pressure liquid refrigerant. The evaporator evaporates the expanded refrigerant from the expansion valve and returns the refrigerant gas at low temperature and pressure to the compressor. This cycle allows the air conditioner to regulate the temperature in the room.

An outdoor unit of the air conditioner may include a compressor and an outdoor heat exchanger. An indoor unit of the air conditioner may include an indoor heat exchanger.

An expansion valve may be located in one of the indoor unit and the outdoor unit. The indoor exchanger and the outdoor heat exchanger serve as a condenser or an evaporator. When the indoor heat exchanger is used as a condenser, the air conditioner performs an indoor heating mode. When the indoor heat exchanger is used as an evaporator, the air conditioner performs an indoor cooling mode.

For ease of explanation, the following describes an indoor unit of a ceiling type air conditioner as an example. However, it is understood that an air conditioner 1 according to an embodiment of the disclosure may also be applied to an indoor unit of other types of air conditioners, such as an indoor unit of a stand-alone air conditioner and an indoor unit of a wall-mounted air conditioner.

For example, the air conditioner 1 may be arranged in a 1-way type. However, the air conditioner 1 may also be arranged in a four-way type. The air conditioner 1 may discharge air in different directions. For ease of explanation, a 1-way type air conditioner will be described below as an example.

Embodiments of the disclosure may provide an air conditioner with improved aesthetics.

Embodiments of the disclosure may provide an air conditioner with improved discharge efficiency.

Embodiments of the disclosure may provide an air conditioner having blades extending left and right.

Embodiments of the disclosure may provide an air conditioner having blades capable of being driven without interfering with other components.

Embodiments of the disclosure may provide an air conditioner capable of translational movement and/or rotational movement.

Embodiments of the disclosure are not limited to the various aspects mentioned above, and other aspects may become apparent to one of ordinary skill in the technical art to which the disclosure belongs from the following description.

Figure 2:
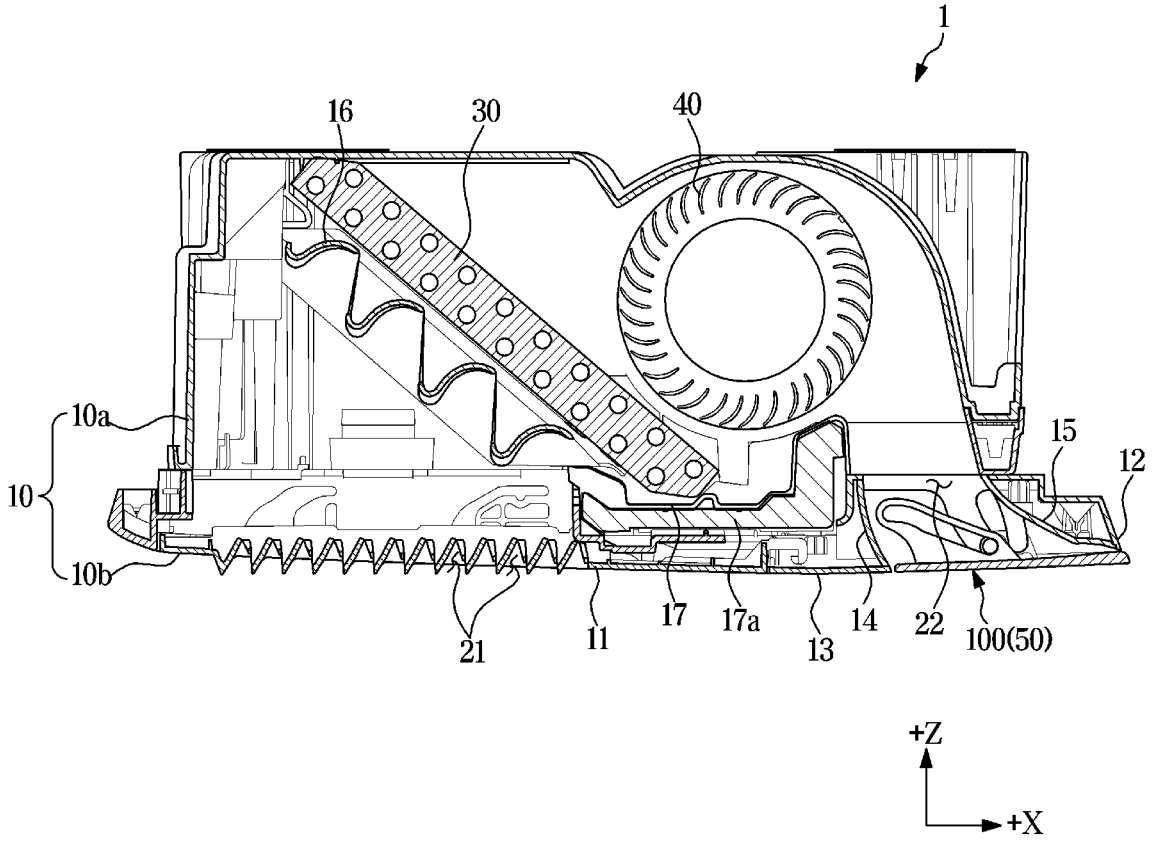
FIG. 2 is a cross-sectional side view illustrating an example of the air conditioner according to an embodiment of the disclosure.

FIG. 1 is a perspective view illustrating an example of an exterior of an air conditioner according to an embodiment. FIG. 2 is a cross-sectional side view illustrating an example of the air conditioner according to an embodiment.

Referring to FIGS. 1 and 2, the air conditioner 1 may include a main body 10. The main body 10 may form the overall appearance of the air conditioner 1.

Various components for driving the air conditioner 1 may be accommodated inside the main body 10.

Flow paths may be provided within the main body 10 to allow air to flow.

The main body 10 may include the inlet 21. The inlet 21 may intake air outside the air conditioner 1 into the air conditioner 1. The inlet 21 may be provided to intake indoor air.

For example, at least one of a grille or a filter member provided to filter out dust in the air intake from the inlet 21 may be provided at the inlet 21.

The main body 10 may include the outlet 22. The outlet 22 may discharge heat-exchanged air to the outside of the air conditioner 1. The outlet 22 may be provided to discharge heat-exchanged air into the room.

For example, the outlet 22 may include a wind direction adjusting member (not shown) for adjusting a direction of air to be discharged.

The main body 10 may include a housing 10*a* and a panel 10*b* coupled to the housing 10*a*, but is not limited thereto. Alternatively, the housing 10*a* and the panel 10*b* may be provided integrally.

The housing 10*a* may be installed on a ceiling C. The housing 10*a* may be suspended from or buried in the ceiling C. For example, the housing 10*a* may be a substantially box-shaped with an open bottom.

The housing 10*a* may accommodate various components of the air conditioner 1. For example, a heat exchanger 30 may be accommodated within the housing 10*a*. For example, a fan 40 may be accommodated within the housing 10*a*. For example, a controller (not shown) provided to control an operation of the air conditioner 1 may be accommodated within the housing 10*a*.

The panel 10*b* may be detachably coupled to a lower portion of the housing 10*a*. The panel 10*b* may be provided to cover the housing 10*a*. The panel 10*b* may be provided to cover the lower portion of the housing 10*a*. At least a portion of the panel 10*b* may be exposed to indoors.

The panel 10*b* may include an inlet panel 11 in which the inlet 21 is formed. The inlet panel 11 may communicate with the housing 10*a*. Air introduced from indoors through the inlet 21 may flow into the main body 10. For example, the inlet panel 11 may be arranged to be exposed to indoors. For example, the inlet panel 11 may have a shape extending substantially in a left-right direction (Y direction).

The panel 10*b* may include an outlet panel 12 in which the outlet 22 is formed. The outlet panel 12 may communicate with the housing 10*a*. Air inside the main body 10 may flow into indoors through the outlet 22. The outlet panel 12 may be disposed at a front side of the inlet panel 11. For example, the outlet panel 12 may have a shape extending substantially in the left-right direction (Y direction). For example, the outlet panel 12 may be covered by the blade 100, which will be to be described later.

The panel 10*b* may include a mid-panel 13 provided between the inlet panel 11 and the outlet panel 12. For example, the mid-panel 13 may be provided to differentiate the inlet panel 11 and the outlet panel 12. For example, the mid-panel 13 may be arranged to be exposed indoors. For example, the mid-panel 13 may have a shape extending substantially in the left-right direction (Y direction).

In the drawings, the mid-panel 13 is shown as being provided in a separate component from the inlet panel 11 and the outlet panel 12, but is not limited thereto. For example, the mid-panel 13 may be integrally formed with the inlet panel 11. For example, the mid-panel 13 may be integrally formed with the outlet panel 12. For example, the mid-panel 13 may be omitted.

The main body 10 may include a guide provided to guide air discharged through the outlet 22.

For example, the guide may include a first guide portion 14 and a second guide portion 15 spaced apart from the first guide portion 14. The second guide portion 15 may be provided in front of the first guide portion 14. Each of the first guide portion 14 and the second guide portion 15 may have a curved shape to prevent flow loss of discharged air.

The first guide portion 14 may be provided as a part of the panel 10*b*. For example, the first guide portion 14 may be provided as a part of the mid-panel 13 or the outlet panel 12. The second guide portion 15 may be provided as a part of the panel 10*b*. For example, the second guide portion 15 may be provided as a part of the outlet panel 12. However, these are not limited to the above examples, and the formation positions of the first guide portion 14 and the second guide portion 15 may vary depending on the configuration of the main body 10. For example, the first guide portion 14 and the second guide portion 15 may be provided as a part of the housing 10*a*.

The air conditioner 1 may include the heat exchanger 30. The heat exchanger 30 may be provided to exchange heat between the air introduced through the inlet 21 and the refrigerant. The heat exchanger 30 may cool or heat the air introduced through the inlet 21. The heat exchanger 30 may be accommodated within the housing 10*a*. The heat exchanger 30 may be disposed between the inlet 21 and the outlet 22.

For example, the heat exchanger 30 may include a tube through which the refrigerant flows. For example, the heat exchanger 30 may include heat exchange fins in contact with the tube to increase the heat transfer area.

The air conditioner 1 may include a drain tray 17 provided to collect condensed water generated by the heat exchanger 30. The drain tray 17 may be disposed below the heat exchanger 30. For example, condensed water collected in the drain tray 17 may be discharged to the outside through a drain hose (not shown) or the like. For example, the drain tray 17 may include a heat insulating material 17*a* for insulating the heat exchanged air. For example, the drain tray 17 may be covered by the mid-panel 13.

The air conditioner 1 may include one or more guide rib 16. The guide rib 16 may be disposed between the heat exchanger 30 and the inlet 21. The guide rib 16 may guide air drawn through the inlet 21 towards the heat exchanger 30. For example, the guide rib 16 may be disposed to be inclined with respect to a direction of arrangement of the heat exchanger 30.

The air conditioner 1 may include the fan 40. The fan 40 may generate a blowing force inside the main body 10. The fan 40 may generate a blowing force inside the housing 10*a*. The fan 40 may force air to flow. The fan 40 may allow air to be drawn in through the inlet 21 or allow air heat-exchanged with the heat exchanger 30 to be discharged through the outlet 22.

In the drawings, the fan 40 is shown as being positioned on an upstream side of a flow direction of air rather than the heat exchanger 30, but is not limited thereto. The fan 40 may be positioned on a downstream side of the flow direction of air rather than the heat exchanger 30.

For example, the fan 40 may be an axial flow fan or a mixed flow fan. However, the type of the fan 40 is not limited thereto as long as the fan 40 is configured to blow air introduced from the outside of the main body 10 to be discharged to the outside of the main body 10. For example, the fan 40 may be a cross fan, a turbo fan, or a sirocco fan.

The air conditioner 1 may include a fan drive device (not shown) provided to drive the fan 40.

For example, the fan drive device may include a fan motor (not shown) provided to rotate the fan 40, but is not limited thereto as long as the fan drive device drives the fan 40.

The air conditioner 1 may include the blade 100. The blade 100 may be disposed to correspond to the outlet 22. The blade 100 may be detachably mounted on the outlet panel 12.

Figure 3:
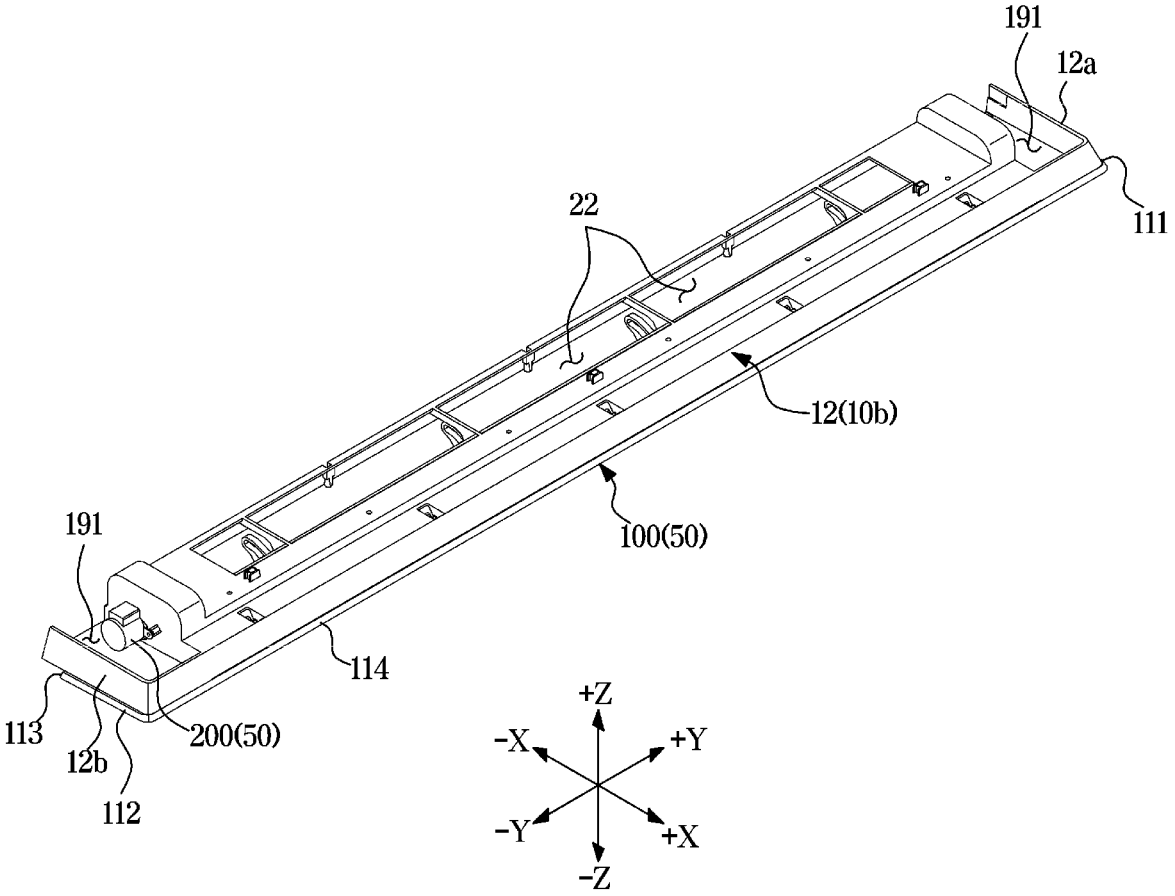
FIG. 3 is a perspective view illustrating some components of the air conditioner according to an embodiment of the disclosure.
Figure 4:
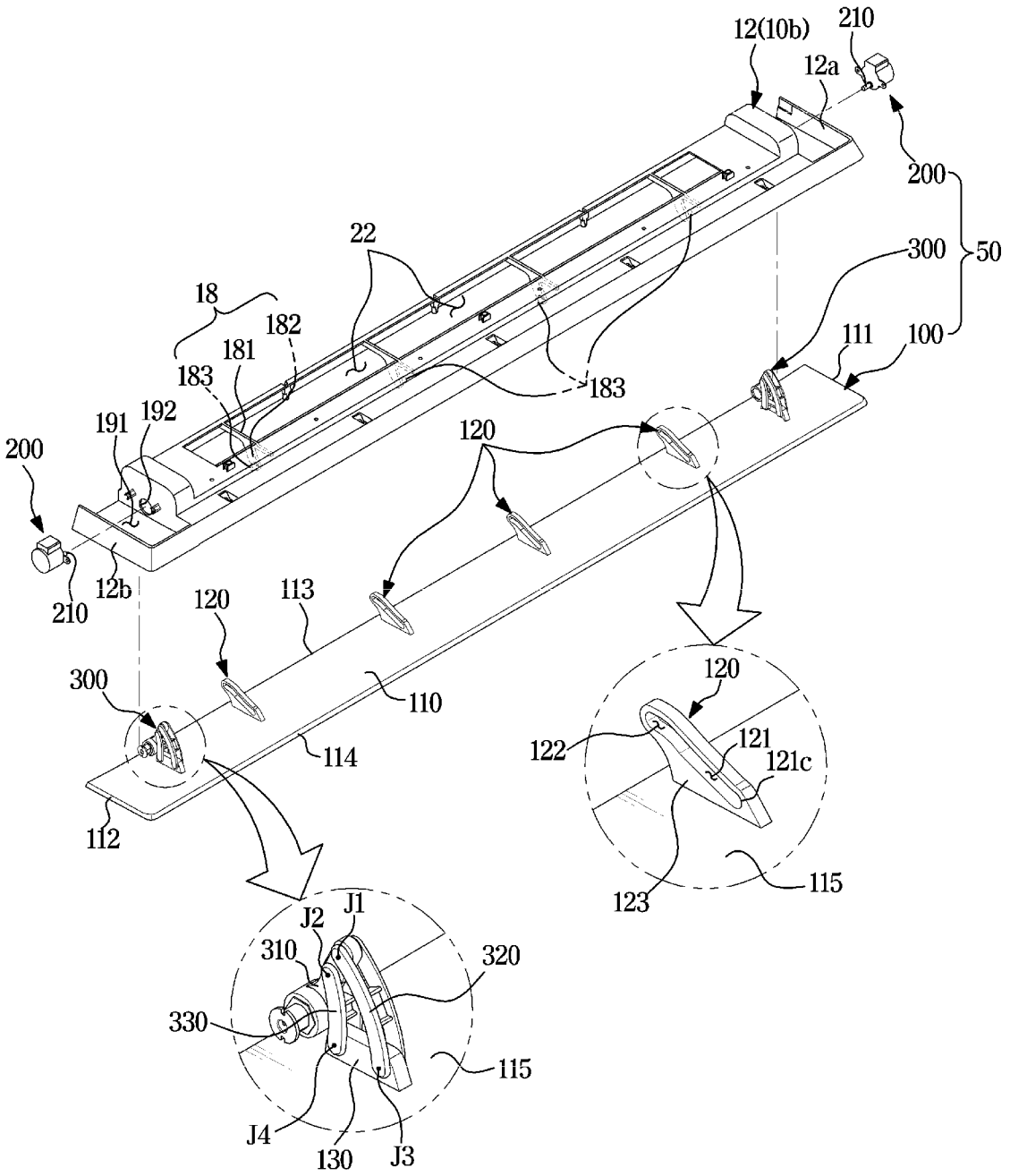
FIG. 4 is an exploded perspective view of some components of the air conditioner shown in FIG. 3 according to an embodiment of the disclosure.
Figure 5:
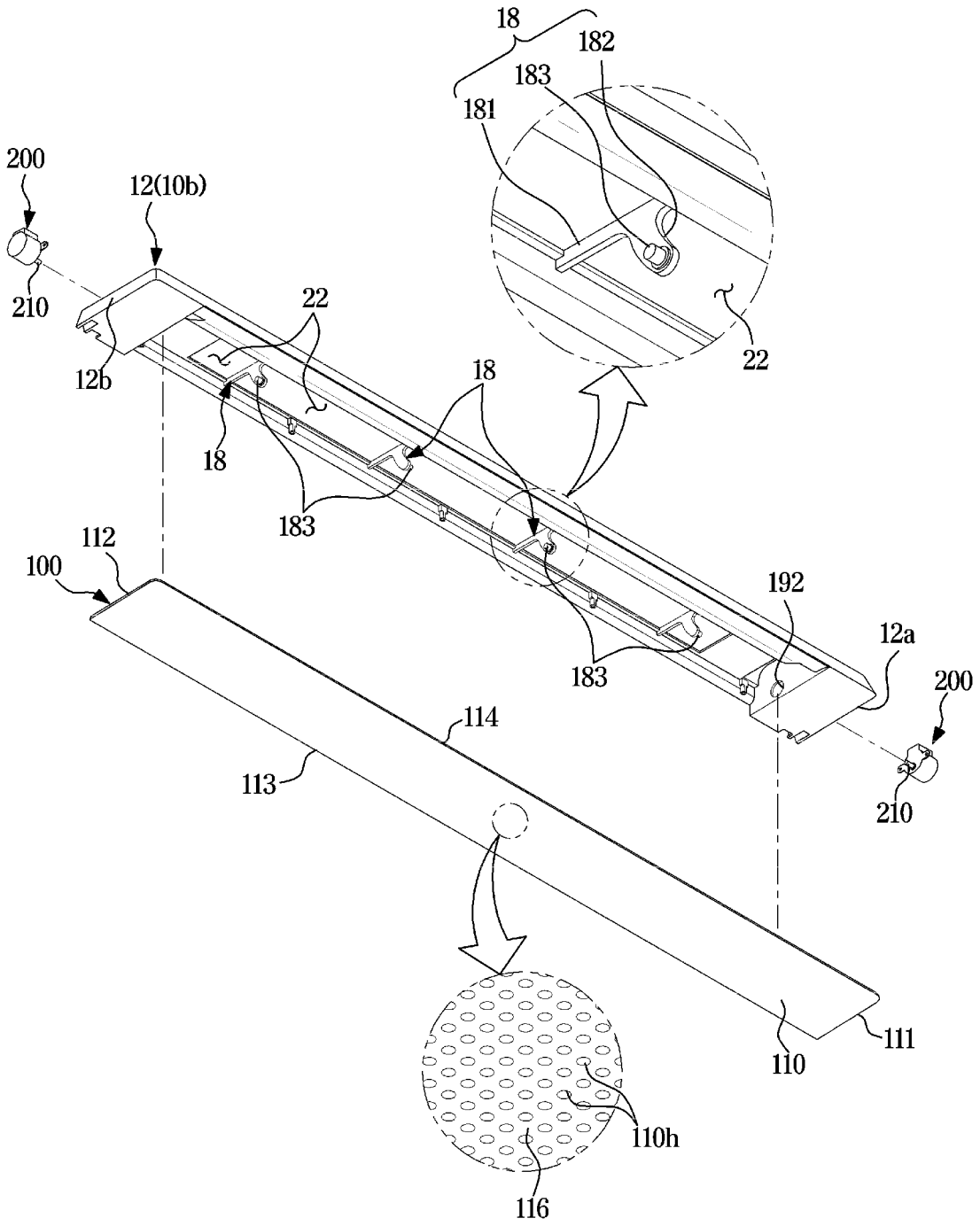
FIG. 5 is an exploded perspective view illustrating some components of the air conditioner shown in FIG. 4 from another direction.
Figure 6:
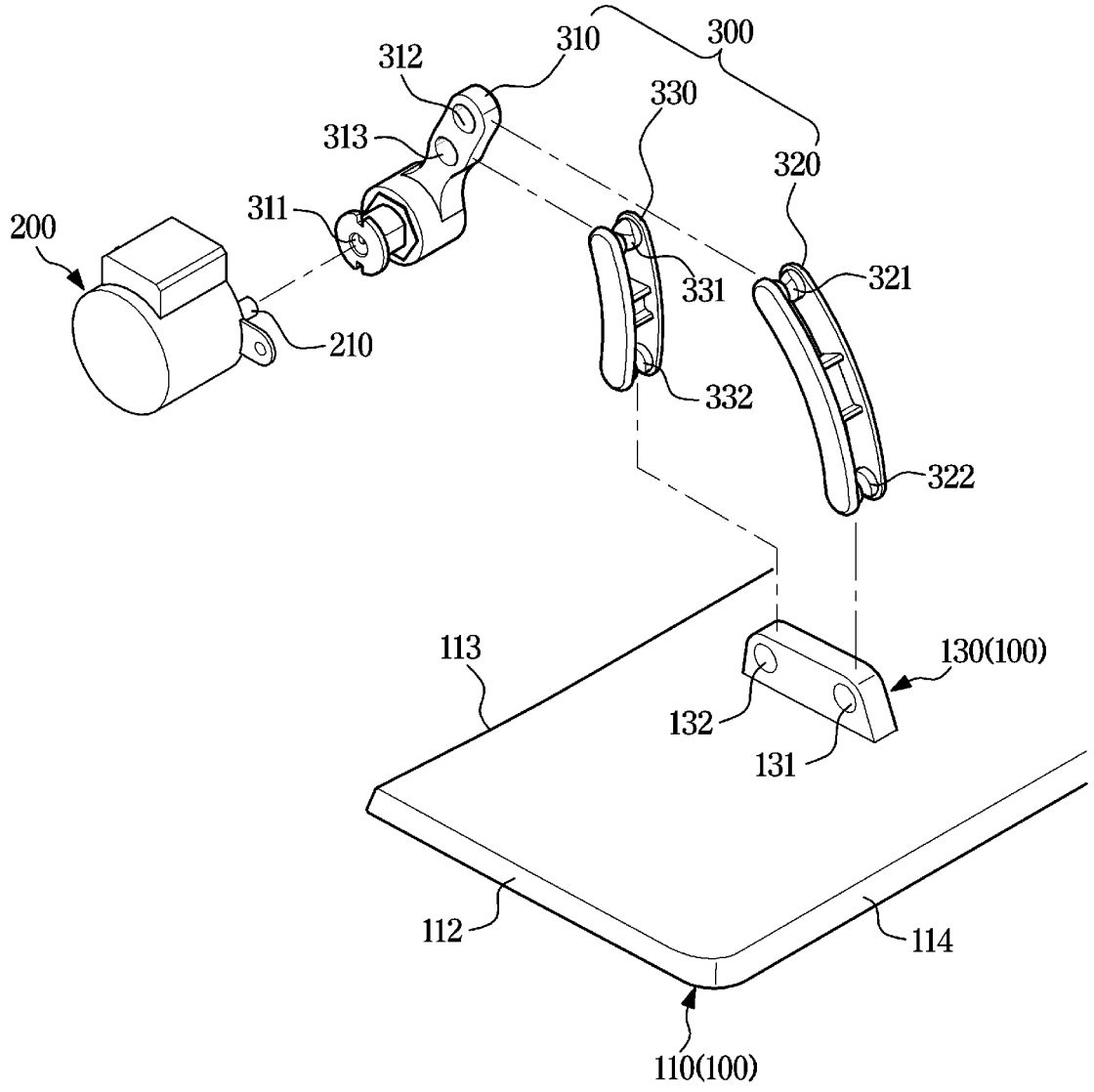
FIG. 6 is an exploded perspective view of a linkage device shown in FIG. 3 according to an embodiment of the disclosure.

FIG. 3 is a perspective view illustrating some components of the air conditioner according to an embodiment. FIG. 4 is an exploded perspective view of some components of the air conditioner shown in FIG. 3. FIG. 5 is an exploded perspective view illustrating some configurations of the air conditioner shown in FIG. 4 from another direction. FIG. 6 is an exploded perspective view of a linkage device shown in FIG. 3.

The outlet panel 12 may include a first side 12*a* and a second side 12*b*, the second side 12*b* being opposite the first side 12*a*. The first side 12*a* and the second side 12*b* may be arranged substantially along the left-right direction (Y direction). For example, the first side 12*a* may be a right side of the outlet panel 12 and the second side 12*b* may be a left side of the outlet panel 12.

The outlet panel 12 may form the outlet 22. The outlet 22 may be formed between the first side 12*a* and the second side 12*b* of the outlet panel 12. The outlet 22 may have a shape extending along a longitudinal direction of the outlet panel 12. For example, the outlet 22 may have a shape extending substantially in the left-right direction (Y direction).

The outlet panel 12 may include a guide protrusion 183 provided at the outlet 22. The guide protrusion 183 may be detachably coupled to the blade 100. The guide protrusion 183 may be slidably coupled to a guide rail 120 of the blade 100, which will be described later.

The outlet panel 12 may include a support member 18 provided to rotatably support the blade 100. The support member 18 may be provided at the outlet 22. The guide protrusion 183 may be provided as a part of the support member 18.

For example, the support member 18 may include a first body portion 181 provided to cross the outlet 12. For example, the outlet panel 12 may include a second body portion 182 extending downwardly from the first body portion 181. For example, the outlet panel 12 may include the guide protrusion 183 protruding from the second body portion 182. For example, the guide protrusion 183 may protrude from the second body portion 182 to the left or to the right.

A motor 200 may be detachably mounted on the outlet panel 12.

For example, the outlet panel 12 may include a motor accommodating portion 191 accommodating the motor 200. The motor accommodating portion 191 may be formed between the first side 12*a* and the second side 12*b* of the outlet panel 12. The motor accommodating portion 191 may be provided inwardly of the first side 12*a* with respect to the left-right direction (Y direction). The motor accommodating portion 191 may be provided inwardly of the second side 12*b* with respect to the left-right direction (Y direction).

For example, the outlet panel 12 may include a connection hole 192 through which the outlet 22 and the motor accommodating portion 191 communicate.

The blade 100 may be provided to open and close the outlet 22. The blade 100 may be provided to cover the outlet 22. The blade 100 may be provided to guide the air discharged through the outlet 22. The blade 100 may be provided to be rotatable relative to the main body 10. The blade 100 may operate in conjunction with the rotation of a linkage device 300 to be described later.

The blade 100 may be provided to correspond to the outlet panel 12. For example, the blade 100 may extend to correspond to the first side 12*a* of the outlet panel 12 and the second side 12*b* of the outlet panel 12. For example, the blade 100 may have a shape extending substantially in the left-right direction (Y direction).

The blade 100 may include a first side 111 and a second side 112, the second side 112 being opposite the first side 111.

The first side 111 of the blade 100 may correspond to the first side 12*a* of the outlet panel 12. When the blade 100 closes the outlet 22, the first side 111 of the blade 100 may cover the first side 12*a* of the outlet panel 12. For example, when the blade 100 closes the outlet 22, the first side 111 of the blade 100 may be provided to continue to the first side 12*a* of the outlet panel 12 without a step or to protrude beyond the first side 12*a* of the outlet panel 12. For example, the first side 111 of the blade 100 may be a right side of the blade 100. The first side 111 may also be referred to as a right portion 111.

For example, when the blade 100 closes the outlet 22, the first side 111 of the blade 100 may be provided to continue to a first side 13*a* of the mid-panel 13 without a step (see FIG. 1). For example, when the blade 100 closes the outlet 22, the first side 11*a* of the inlet panel 11, the first side 13*a* of the mid-panel 13, and the first side 111 of the blade 100 may be provided to continue towards each other without a step (see FIG. 1). Accordingly, the aesthetics of the air conditioner 1 may be improved. The air conditioner 1 may have a seamless appearance.

The second side 112 of the blade 100 may correspond to the second side 12*b* of the outlet panel 12. When the blade 100 closes the outlet 22, the second side 112 of the blade 100 may cover the second side 12*b* of the outlet panel 12. For example, when the blade 100 closes the outlet 22, the second side 112 of the blade 100 may be provided to continue to the second side 12*b* of the outlet panel 12 without a step or to protrude beyond the second side 12*b* of the outlet panel 12 (see FIG. 3). For example, the second side 112 of the blade 100 may be a left side of the blade 100. The second side 112 may also be referred to as a left portion 112.

For example, when the blade 100 closes the outlet 22, the second side 112 of the blade 100 may be provided to continue to a second side 13*b* of the mid-panel 13 without a step (see FIG. 1). For example, when the blade 100 closes the outlet 22, the second side 11*b* of the inlet panel 11, the second side 13*b* of the mid-panel 13, and the second side 112 of the blade 100 may be provided to continue towards each other without a step. Accordingly, the aesthetics of the air conditioner 1 may be improved. The air conditioner 1 may have a seamless appearance.

For example, the motor accommodating portion 191 of the outlet panel 12 may be provided to be located inwardly of the blade 100 in the left-right direction (Y direction). For example, the motor 200 mounted in the motor accommodating portion 191 may be provided to be located inwardly of the blade 100 in the left-right direction (Y direction). For example, the motor 200 may be disposed between the first side 111 and the second side 112 of the blade 100. Accordingly, the motor 200 may be disposed such that it does not to protrude beyond the blade 100.

Generally, a blade may be provided in a size corresponding to an outlet formed in an outlet panel. For example, the blade may have a size smaller than that of the outlet panel, a left side of the blade may be placed inwardly from a left side of the outlet panel, and a right side of the blade may be placed inwardly from a right side of the outlet panel. As a result, when the blade closes the outlet, an area of the outlet panel other than the outlet may be exposed to indoors. When the blade opens the outlet, the air in the main body flows only through the outlet of the outlet panel, so that a discharge area of the air conditioner may be limited. In addition, a motor mounted on the outlet panel may be arranged to protrude beyond the blade.

In a contrast, the blade 100 according to the disclosure may be provided to cover the outlet panel 12. The blade 100 may be provided to cover the outlet panel 12 when the outlet 22 is closed. Accordingly, the outlet panel 12 may not be exposed to indoors (see FIG. 1). For example, the blade 100 may extend to correspond to the first side 12*a* of the outlet panel 12 and the second side 12*b* of the outlet panel 12. For example, when the blade 100 closes the outlet 22, the first side 111 of the blade 100 may cover the first side 12*a* of the outlet panel 12. For example, when the blade 100 closes the outlet 22, the second side 112 of the blade 100 may cover the second side 12*b* of the outlet panel 12. In other words, the blade 100 may have a shape that is substantially extended in the left-right direction (Y direction) compared to the conventional blade. Therefore, when the blade 100 closes the outlet 22, the outlet panel 12 is covered by the blade 100 and thus is not exposed to indoors. In other words, when the blade 100 closes the outlet 22, the blade 100 forms an integral aesthetic sense and thus the aesthetics of the air conditioner 1 may be improved. Because an opening range of the blade 100 in the left and right directions is increased compared to the conventional manner, the discharge area of the air conditioner 1 may be improved. In addition, the motor 200 mounted on the outlet panel may be disposed inwardly from the blade 100 in the left-right direction (Y direction). As a result, the motor 200 may be disposed not to protrude beyond the blade 100.

The blade 100 may include a third side 113 and a fourth side 114, the fourth side 114 being opposite the third side 113.

The third side 113 of the blade 100 may be provided on a rear side of the fourth side 114 of the blade 100. The fourth side 114 of the blade 100 may be provided on a front side of the third side 113 of the blade 100.

For example, the third side 113 of the blade 100 may be a rear 113 of the blade 100. The third side 113 may also be referred to as a rear portion.

For example, the fourth side 114 of the blade 100 may be a front 114 of the blade 100. The fourth side 114 may also be referred to as a front portion.

For example, the third side 113 of the blade 100 may be provided closer to the outlet 22 than the fourth side 114. The third side 113 of the blade 100 may be provided closer to the inlet 21 than the fourth side 114. The third side 113 of the blade 100 may be provided closer to the mid-panel 13 than the fourth side 114.

The blade 100 may include a blade body 110.

The blade body 110 may adjust the direction of flow of the air discharged from the outlet 22. The blade body 110 may be provided to be rotatable relative to the outlet 22. For example, the blade body 110 may be provided to rotatable by the linkage device 300.

The blade body 110 may define the overall appearance of the blade 100. For example, the blade body 110 may have a substantially rectangular shape having a pair of long sides and a pair of short sides.

The blade body 110 may be provided to cover at least a portion of the main body 10. The blade body 110 may be provided to cover at least a portion of a left side of the panel 10*b*. The blade body 110 may be provided to cover at least a portion of a right side of the panel 10*b*.

The blade body 110 may be provided to cover the outlet panel 12. The blade body 110 may extend to correspond to the first side 12*a* and the second side 12*b* of the outlet panel 12. For example, the blade body 110 may have a shape extending substantially in the left-right direction (Y direction).

For example, the first side 111 of the blade 100 may refer to the first side 111 of the blade body 110. For example, the second side 112 of the blade 100 may refer to the second side 112 of the blade body 110. For example, the third side 113 of the blade 100 may refer to the third side 113 of the blade body 110. For example, the fourth side 114 of the blade 100 may refer to the fourth side 114 of the blade body 110.

For example, the first side 111 and the second side 112 may be provided as a pair of short sides of the blade body 110. For example, the third side 113 and the fourth side 114 may be provided as a pair of long sides of the blade body 110.

For example, the blade 100 may include a plurality of discharge holes 110*h*. The plurality of discharge holes 110*h* may be formed in the blade body 110. The plurality of discharge holes 110*h* may be formed through a first surface 115 of the blade body 110 facing the outlet 22, and a second surface 116 provided opposite the first surface 115. The first surface 115 may also be referred to as the inner surface 115 of the blade body 110. The second surface 116 may also be referred to as the outer surface 116 of the blade body 110.

When the blade 100 closes the outlet 22, the air conditioner 1 may discharge heat-exchanged air into indoors through the plurality of discharge holes 110*h* (see FIG. 5). The air conditioner 1 may discharge air at a predetermined speed or less through the plurality of discharge holes 110*h*. Therefore, the air discharged from the air conditioner 1 may not directly touch the user, and the air conditioner 1 may implement a windless air flow.

The blade 100 may include a guide rail 120.

The guide rail 120 may be formed on the first surface 115 of the blade body 110 facing the outlet 22. For example, the guide rail 120 may protrude substantially vertically from the first surface 115 of the blade body 110.

The guide rail 120 may be slidably supported on the guide protrusion 183. The guide rail 120 may be provided to move relative to the guide protrusion 183. The guide rail 120 may be rotatably supported by the support member 18 of the main body 10. The guide rail 120 may be provided to move relative to the support member 18 of the main body 10. The guide rail 120 may be detachably coupled to the guide protrusion 183.

As the blade 100 rotates, the guide rail 120 may slide and/or rotate while being coupled to the guide protrusion 183. As the blade 100 rotates, the guide rail 120 may be provided to slide while being coupled to the guide protrusion 183. The blade 100 may be provided to rotate relative to the main body 10 by the sliding movement of the guide rail 120. The blade 100 may be provided to move forward or backward with respect to the main body 10 by the sliding movement of the guide rail 120.

The guide rail 120 may be provided to guide a movement of the blade 100. The guide rail 120 may be provided to guide a movement of the blade body 110. The guide rail 120 may guide the movement of the blade body 110 with respect to the main body 10 by interworking with the rotation of the blade body 110. The guide rail 120 may guide at least one of a translational movement or a rotational movement of the blade body 110 with respect to the main body 10 by interworking with the rotation of the blade body 110. That is, the blade 100 may perform at least one of a translational movement or a rotational movement by means of the guide rail 120. In other words, the blade 100 may perform translational movement, rotational movement, or a combination of translational movement and rotational movement by means of the guide rail 120. As a result, the blade 100 may be driven in a variety of ways and interference with other components may be avoided. A detailed description of this will be described later.

The guide rail 120 is provided to restrain the blade 100 and may guide the blade 100 to drive in a predetermined direction.

The guide rail 120 may include a first section 121 and a second section 122.

The first section 121 may be provided to be inclined downwardly along the direction of air flow. The first section 121 may have a straight line shape.

As the blade 100 rotates in a state in which the guide rail 120 is coupled to the guide protrusion 183, the guide rail 120 may slide to allow the guide protrusion 183 to be placed in the first section 121.

When the guide rail 120 slides so that the guide protrusion 183 is placed in the first section 121, the blade 100 may perform a translational movement and/or a rotational movement with respect to the main body 10. When the guide rail 120 slides so that the guide protrusion 183 is placed in the first section 121, the blade body 110 may rotate while moving linearly with respect to the main body 10.

For example, when the guide protrusion 183 is placed within a predetermined section of the first section 121, the blade 100 may move forward or backward without rotating. The blade 100 may not interfere with other components of the air conditioner 1. The forward or backward movement of the blade 100 allows a distance between the blade 100 and the mid-panel 13 to be adjusted.

For example, the first section 121 may include a curved portion 121*c*. The curved portion 121*c* may be formed at an end of the first section 121. The curved portion 121*c* may be formed at a front end of the first section 121. The curved portion 121*c* may be provided to minimize a gap between the blade 100 and the mid-panel 13 in a state where the blade 100 closes the outlet 22. For example, when the guide rail 120 slides so that the guide protrusion 183 is positioned at the curved portion 121*c* of the first section 121, the blade 100 may only perform a translational movement within a predetermined range. However, it is not limited to the above example, and the blade 100 may be provided to perform different movements according to different shapes of the first section 121 of the guide rail 120. For example, it is sufficient if the blade 100 may be arranged to perform at least one of a translational movement or a rotational movement.

The second section 122 may extend from an upper portion of the first section 121. The second section 122 may have a curved shape. The second section 122 may be provided to have a predetermined radius of curvature.

When the blade 100 rotates in a state where the guide rail 120 is coupled with the guide protrusion 183, the guide rail 120 may slide so that the guide protrusion 183 is placed in the second section 122. When the guide rail 120 slides so that the guide protrusion 183 is placed in the second section 122, the blade 100 may rotate with respect to the main body 10. When the guide rail 120 slides so that the guide protrusion 183 is placed in the second section 122, the blade body 110 may rotate with respect to the main body 100.

The first section 121 may be provided on a downstream side of the second section 122 in the direction of air flow. The first section 121 may be formed closer to the third side 113 of the blade 100 than the second section 122. When the blade 100 closes the outlet 22, the first section 121 may be provided before the second section 122.

For example, the guide rail 120 may include a rail body 123 extending from the first surface 115 of the blade body 110. The first section 121 may be formed passing through the rail body 123. The second section 122 may be formed passing through the rail body 123.

For example, a plurality of guide rails 120 may be provided. The plurality of guide rails 120 may be arranged along the longitudinal direction of the blade 100. The plurality of guide rails 120 may be arranged along the longitudinal direction of the blade body 110. Although four guide rails 120 are shown in the drawings, there is no limit to the number of guide rails 120. The guide rails 120 may be provided with one, five or more guide rails.

For example, the guide rail 120 may be arranged to be located inwardly of the blade body 110 than the linkage device 300.

The blade 100 may include a connecting rib 130 for connection with the linkage device 300.

The connecting rib 130 may be formed to be spaced apart from the guide rail 120. The connecting rib 130 may be formed on the first surface 115 of the blade body 110 facing the outlet 22. For example, the connecting rib 130 may protrude substantially vertically from the first surface 115 of the blade body 110.

The connecting rib 130 may be rotatably connected to the linkage device 300. For example, the connecting rib 130 may include a first connection portion 131 rotatably connected to the second link 320 of the linkage device 300 to be described later. For example, the first connection portion 131 may be provided as a hole. For example, the connecting rib 130 may include a second connection portion 132 rotatably connected to the third link 330 of the linkage device 300 to be described later. For example, the second connection portion 132 may be provided as a hole.

The connecting rib 130 may be provided in a number corresponding to that of the linkage device 300. For example, a plurality of connecting ribs 130 may be provided. The plurality of connecting ribs 130 may be arranged along the longitudinal direction of the blade 100. The plurality of connecting ribs 130 may be arranged along the longitudinal direction of the blade body 110. In the drawings, the connecting ribs 130 are shown as two, but the number of the connecting ribs 130 is not limited thereto. If the number of connecting ribs 130 corresponds to the number of linkage devices 300, it may be provided with one or three or more.

For example, two connecting ribs 130 may be provided, one of the two connecting ribs 130 may be disposed adjacent to the first side 111 of the blade 100 and the other of the two connecting ribs 130 may be disposed adjacent to the second side 112 of the blade 100. For example, the guide rails 120 may be disposed between two connecting ribs 130.

The air conditioner 1 may include the motor 200. The motor 200 may generate a rotational force for driving the blade 100. The motor 200 may include a motor shaft 210. The motor shaft 210 of the motor 200 may be connected to the linkage device 300. The motor 200 may transmit a rotational force to the linkage device 300 through the motor shaft 210. The motor shaft 210 of the motor 200 may form a center of rotation M.

The motor 200 may be detachably mounted on the outlet panel 12. The motor 200 may be accommodated in the motor accommodating portion 191 of the outlet panel 12. The motor shaft 210 of the motor 200 may pass through the connection hole 192 of the outlet panel 12 to be connected to the linkage device 300.

For example, the motor 200 may include a stepper motor. The motor 200 may be a variable reluctance type stepper motor with excellent rotation angle resolution. The motor 200 may freely implement a swing mode requiring a continuous change of direction change as well as a step change of direction of the blade 100, but is not limited thereto. Various power devices capable of realizing a change of direction of the blade 100 may also be used.

The air conditioner 1 may include the linkage device 300. The linkage device 300 may be provided to transmit a rotational force generated by the motor 200 to the blade 100. The linkage device 300 may connect the motor 200 and the blade 100. The linkage device 300 may connect the motor 200 and the blade body 110. The linkage device 300 may be rotatably connected to the connecting rib 130 of the blade 100.

For example, the linkage device 300 may include a plurality of linkages. For example, the linkage device 300 may include a first link 310. For example, the linkage device 300 may include a second link 320. For example, the linkage device 300 may include a third link 330.

The first link 310 may be rotatably connected to the motor 200. One end of the first link 310 may be connected to the motor shaft 210 of the motor 200. The other end of the first link 310 may be provided to rotate about one end. The first link 310 may rotate in the same direction as the direction of rotation of the motor 200. For example, the first link 310 may rotate in a first direction R1.

For example, the first link 310 may include a first coupling portion 311 rotatably coupled to the motor 200. For example, the first coupling portion 311 may be formed at one end of the first link 310.

For example, the first link 310 may include a second coupling portion 312 rotatably coupled to the second link 320. For example, the second coupling portion 312 may be formed at the other end of the first link 310.

For example, the first link 310 may include a third coupling portion 313 rotatably coupled to the third link 330. For example, the third coupling portion 313 may be formed between the first coupling portion 311 and the second coupling portion 312.

The second link 320 may be provided to connect the first link 310 and the blade 100. The second link 320 may be provided to connect the first link 310 and the blade body 110. The second link 320 may be rotatably connected to the first connection portion 131 of the connecting rib 130 of the blade 100.

The second link 320 may rotate in conjunction with the rotation of the first link 310. For example, the second link 320 may rotate in a direction opposite to the direction of rotation of the first link 310. For example, when the first link 310 rotates in the first direction R1 within a predetermined range, the second link 320 rotates in a second direction R2, which is opposite to the first direction R1 within a predetermined range. For example, when the first link 310 rotates in the second direction R2 within a predetermined range, the second link 320 may rotate in the first direction R1 within a predetermined range.

For example, the second link 320 may include a fourth coupling portion 321 rotatably coupled to the second coupling portion 312 of the first link 310. For example, the fourth coupling portion 321 may be formed at one end of the second link 320. For example, the second coupling portion 312 may be provided as a hole, and the fourth coupling portion 321 may be provided as a protrusion and inserted into the second coupling portion 312, but is not limited thereto. The second coupling portion 312 may be provided as a protrusion and the fourth coupling portion 321 may be provided as a hole.

For example, the second link 320 may include a fifth coupling portion 322 rotatably coupled to the first connection portion 131 of the connecting rib 130. For example, the fifth coupling portion 322 may be formed at the other end of the second link 320. For example, the first connection portion 131 may be provided as a hole, and the fifth coupling portion 322 may be provided as a protrusion and inserted into the first connection portion 131, but is not limited thereto. The first connection portion 131 may be provided as a protrusion and the fifth coupling portion 322 may be provided as a hole.

The third link 330 may be disposed closer to the motor 200 than the second link 320. The third link 330 may be provided to connect the first link 310 and the blade 100. The third link 330 may be provided to connect the first link 310 and the blade body 110. The third link 330 may be rotatably connected to the second connection portion 132 of the connecting rib 130 of the blade 100.

The third link 330 may rotate in conjunction with the rotation of the first link 310. For example, the third link 330 may rotate in a direction opposite to the direction of rotation of the first link 310. For example, when the first link 310 rotates in the first direction R1 within a predetermined range, the third link 330 rotates in the second direction R2, which is opposite to the first direction R1 within a predetermined range. For example, when the first link 310 rotates in the second direction R2 within a predetermined range, the third link 330 may rotate in the first direction R1 within a predetermined range.

For example, the third link 330 may include a sixth coupling portion 331 rotatably coupled to the third coupling portion 313 of the first link 310. For example, the sixth coupling portion 331 may be formed at one end of the third link 330. For example, the third coupling portion 313 may be provided as a hole, and the sixth coupling portion 331 may be provided as a protrusion and inserted into the third coupling portion 313, but is not limited thereto. The third coupling portion 313 may be provided as a protrusion and the sixth coupling portion 331 may be provided as a hole.

For example, the third link 330 may include a seventh coupling portion 332 rotatably coupled to the second connection portion 132 of the connecting rib 130. For example, the seventh coupling portion 332 may be formed at the other end of the third link 330. For example, the second connection portion 132 may be provided as a hole, and the seventh coupling portion 332 may be provided as a protrusion and inserted into the second connection portion 132, but is not limited thereto. The second connection portion 132 may be provided as a protrusion and the seventh coupling portion 332 may be provided as a hole.

The second link 320 and the third link 330 may be provided to have different lengths. The length of the third link 330 may be provided to be shorter than the length of the second link 320. Due to a difference in length between the second link 320 and the third link 330, the blade 100 may rotate to allow the outlet 22 to open. For example, an amount of rotation of the fourth side 114 of the blade 100 about the motor shaft 210 may be greater than an amount of rotation of the third side 113 of the blade 100 about the motor shaft 210.

The linkage device 300 may include a first joint J1 (see FIGS. 4, 8, 11 and 14). The first joint J1 may be formed at a connection portion between the first link 310 and the second link 320. For example, the first joint J1 may be formed by the second coupling portion 312 of the first link 310 and the fourth coupling portion 321 of the second link 320.

The linkage device 300 may include a second joint J2 (see FIGS. 4, 8, 11 and 14). The second joint J2 may be formed at a connection portion between the first link 310 and the third link 330. For example, the second joint J2 may be formed by the third coupling portion 313 of the first link 310 and the sixth coupling portion 331 of the third link 330.

The linkage device 300 may include a third joint J3 (see FIGS. 4, 8, 11 and 14). The third joint J3 may be formed at a connection portion between the second link 320 and the blade 100. For example, the third joint J3 may be formed by the fifth coupling portion 322 of the second link 320 and the first connection portion 131 of the connecting rib 130.

The linkage device 300 may include a fourth joint J4 (see FIGS. 4, 8, 11 and 14). The fourth joint J4 may be formed at a connection portion between the third link 330 and the blade 100. For example, the fourth joint J4 may be formed by the seventh coupling portion 332 of the third link 330 and the second connection portion 132 of the connecting rib 130.

For example, a plurality of linkage devices 300 may be provided. The plurality of linkage devices 300 may be arranged along the longitudinal direction of the blade 100. The plurality of linkage devices 300 may be arranged along the longitudinal direction of the blade body 110. Although the number of linkage devices 300 is shown as two in the drawing, the number is not limited thereto. The linkage device 300 may be provided with one or three or more.

For example, two linkage devices 300 are provided, one of the two linkage devices 300 is disposed adjacent to the first side 111 of the blade 100, and the other of the two linkage devices 300 is disposed adjacent to the second side 112 of the blade 100. For example, the guide rails 120 may be provided between two linkage devices 300.

Typically, a blade is directly coupled to a motor shaft of the motor to rotate around the motor shaft. In this case, the degree of freedom of rotation of the blade may be limited as the blade rotates on only one shaft.

In a contrast, the blade 100 may rotate by receiving a rotational force of the motor 200 from the linkage device 300. Accordingly, the blade 100 may rotate in conjunction with the rotation of the linkage device 300, and the degree of freedom of rotation may be improved by a link structure of the linkage device 300. The linkage device 300 may have a structure in which the rotational movement of the blade 100 may be converted into a compound drive (rotational movement and/or translational movement) by increasing the degree of freedom of rotation of the blade 100. In other words, the blade 100 may be provided to rotate by the linkage device 300 and simultaneously perform at least one of a translational movement or a rotational movement by being guided by the guide rail 120.

For example, the blade 100, the motor 200, and the linkage device 300 may be referred to as a blade assembly 50.

Figure 7:
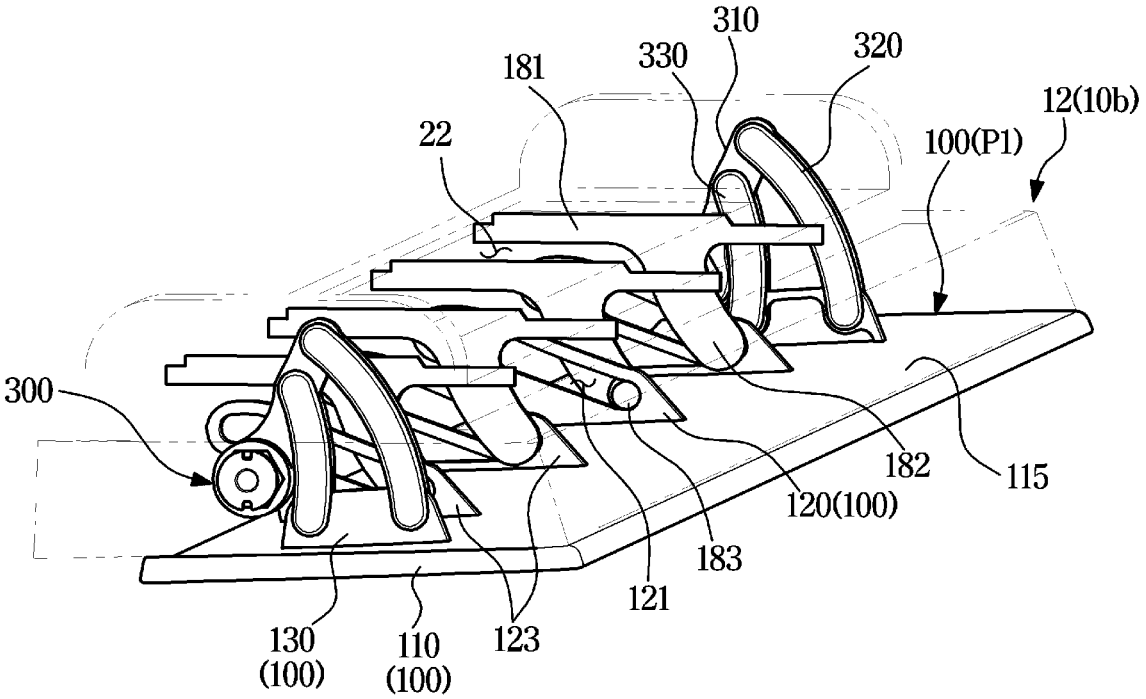
FIG. 7 is a view illustrating a case in which blades of the air conditioner according to an embodiment of the disclosure are provided at a first position P1.
Figure 8:
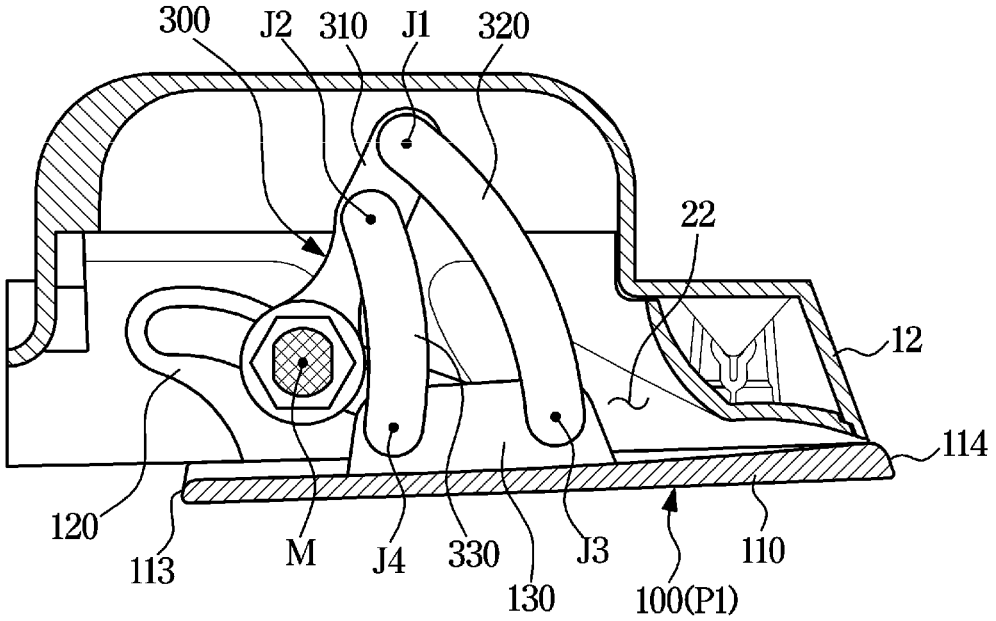
FIG. 8 is a view of the linkage device shown in FIG. 7.
Figure 9:
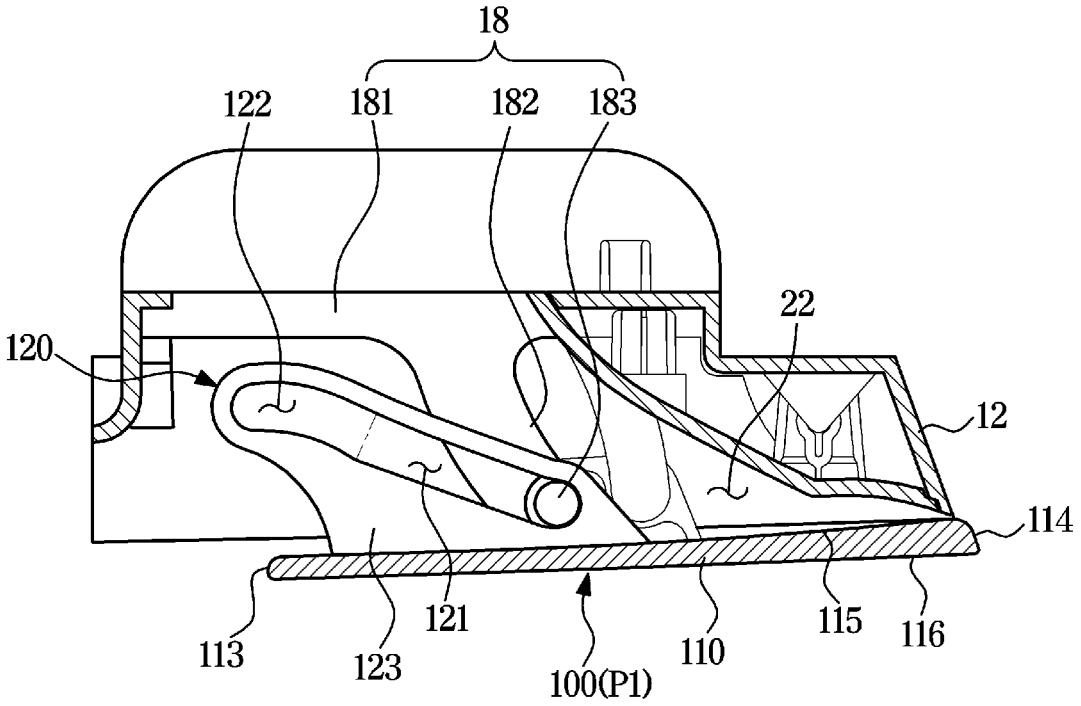
FIG. 9 is a view of a guide rail shown in FIG. 7.
Figure 10:
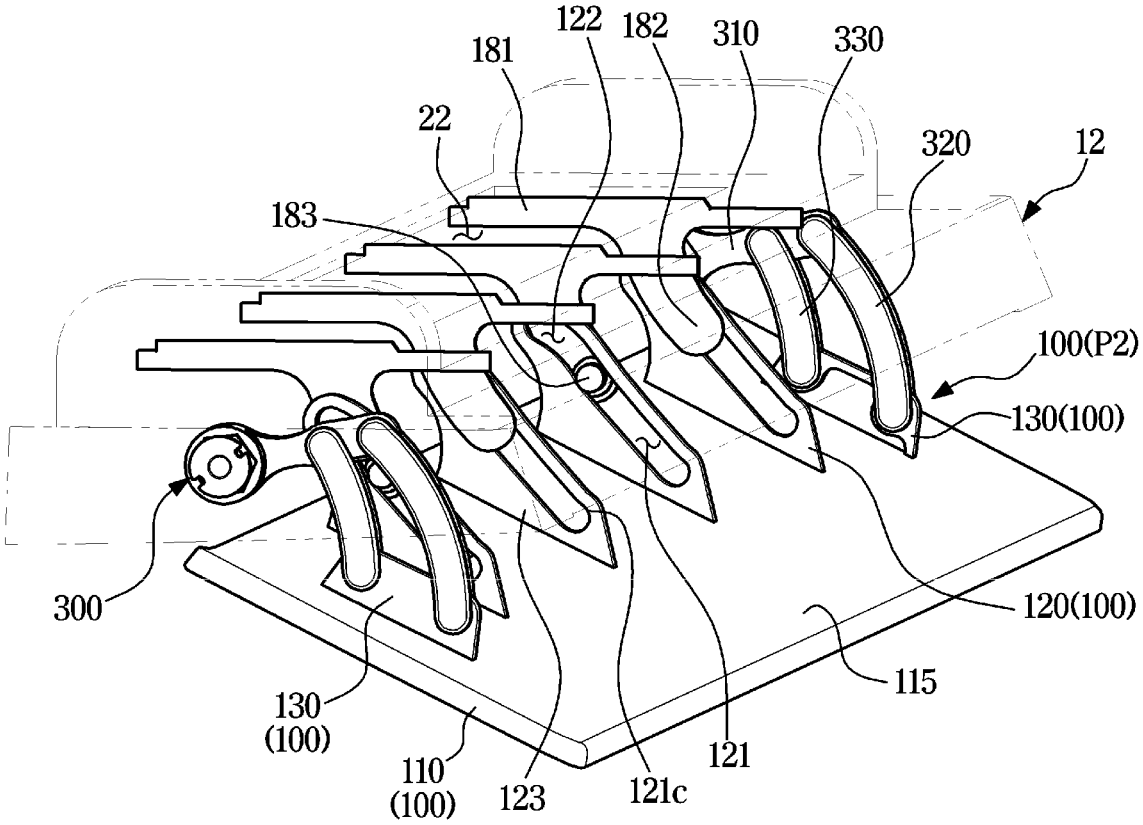
FIG. 10 is a view illustrating a case in which blades of the air conditioner according to an embodiment of the disclosure are provided at a second position P2.
Figure 11:
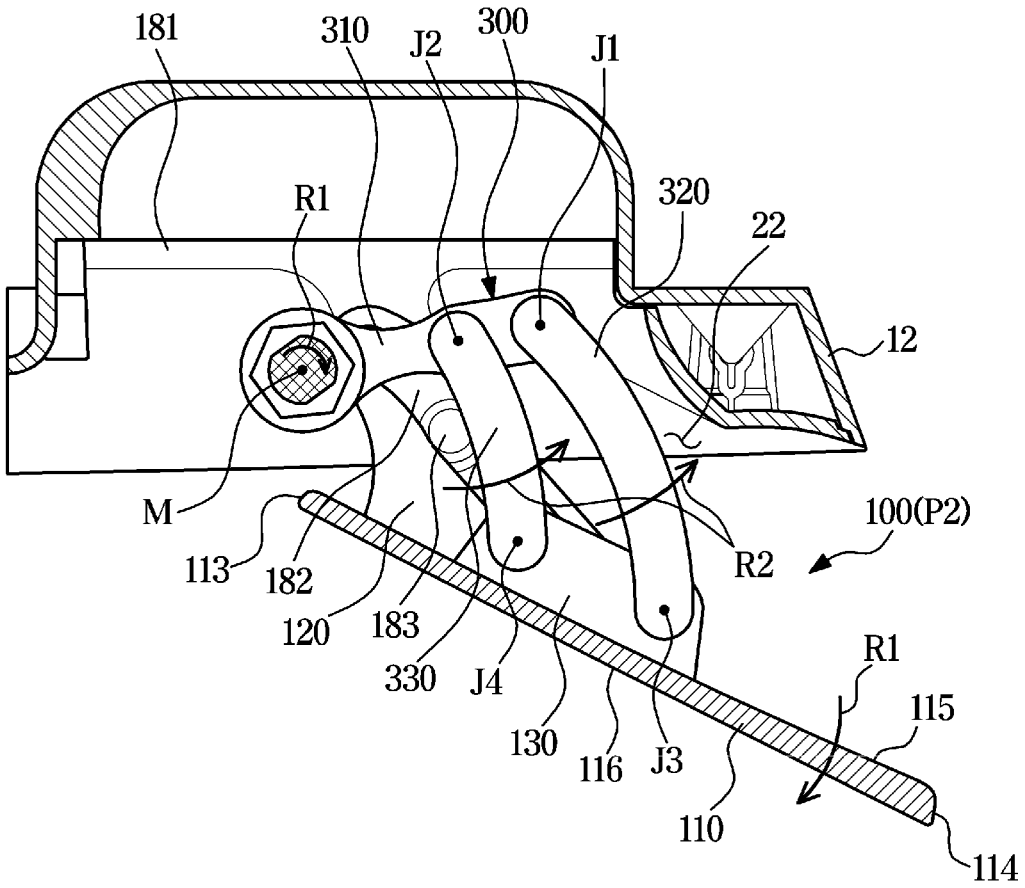
FIG. 11 is a view of the linkage device shown in FIG. 10.
Figure 12:
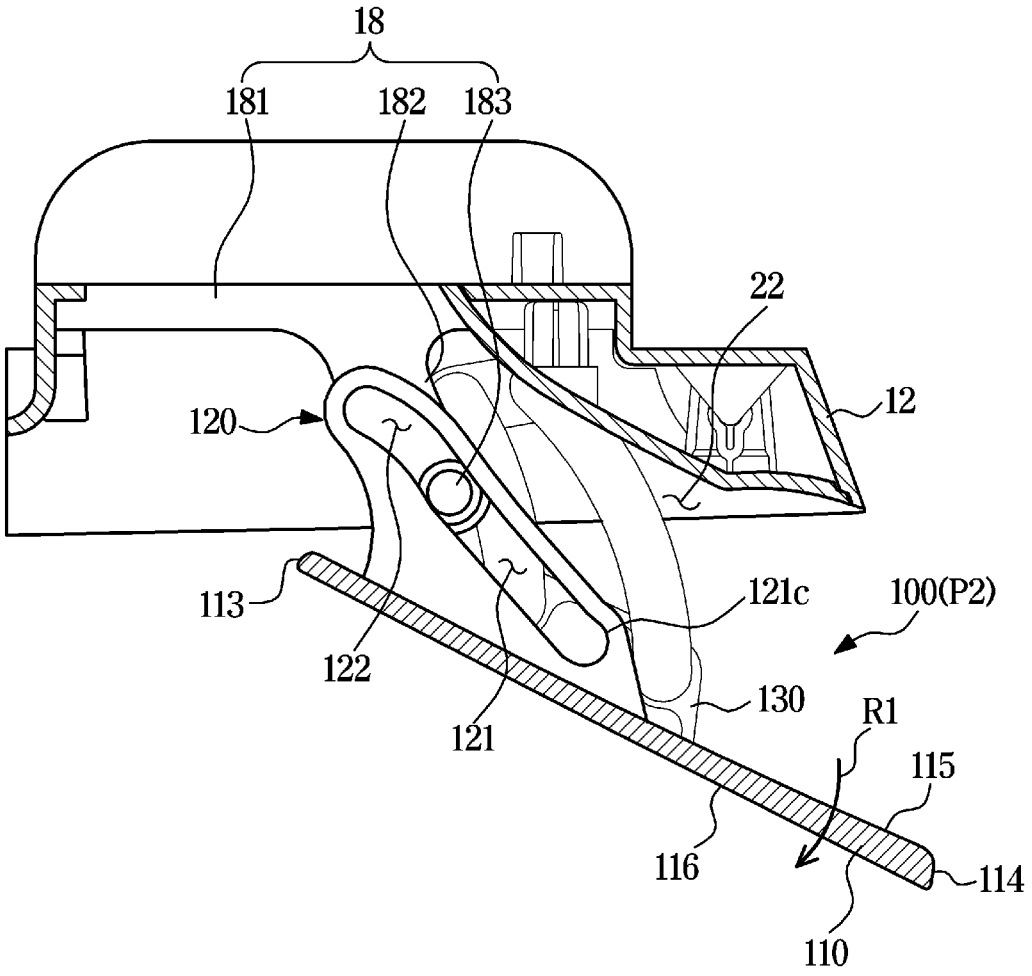
FIG. 12 is a view of the guide rail shown in FIG. 10.
Figure 13:
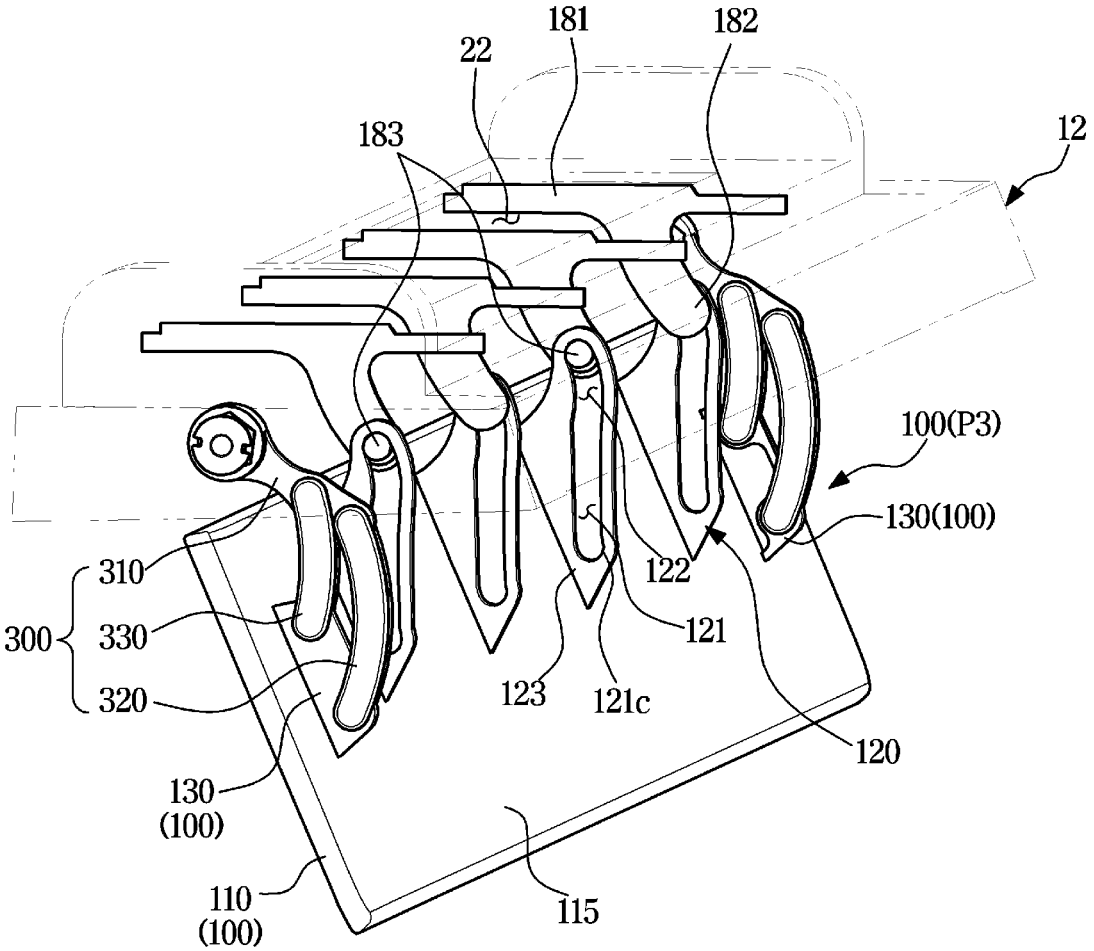
FIG. 13 is a view illustrating a case in which blades of the air conditioner according to an embodiment of the disclosure are provided at a third position P3.
Figure 14:
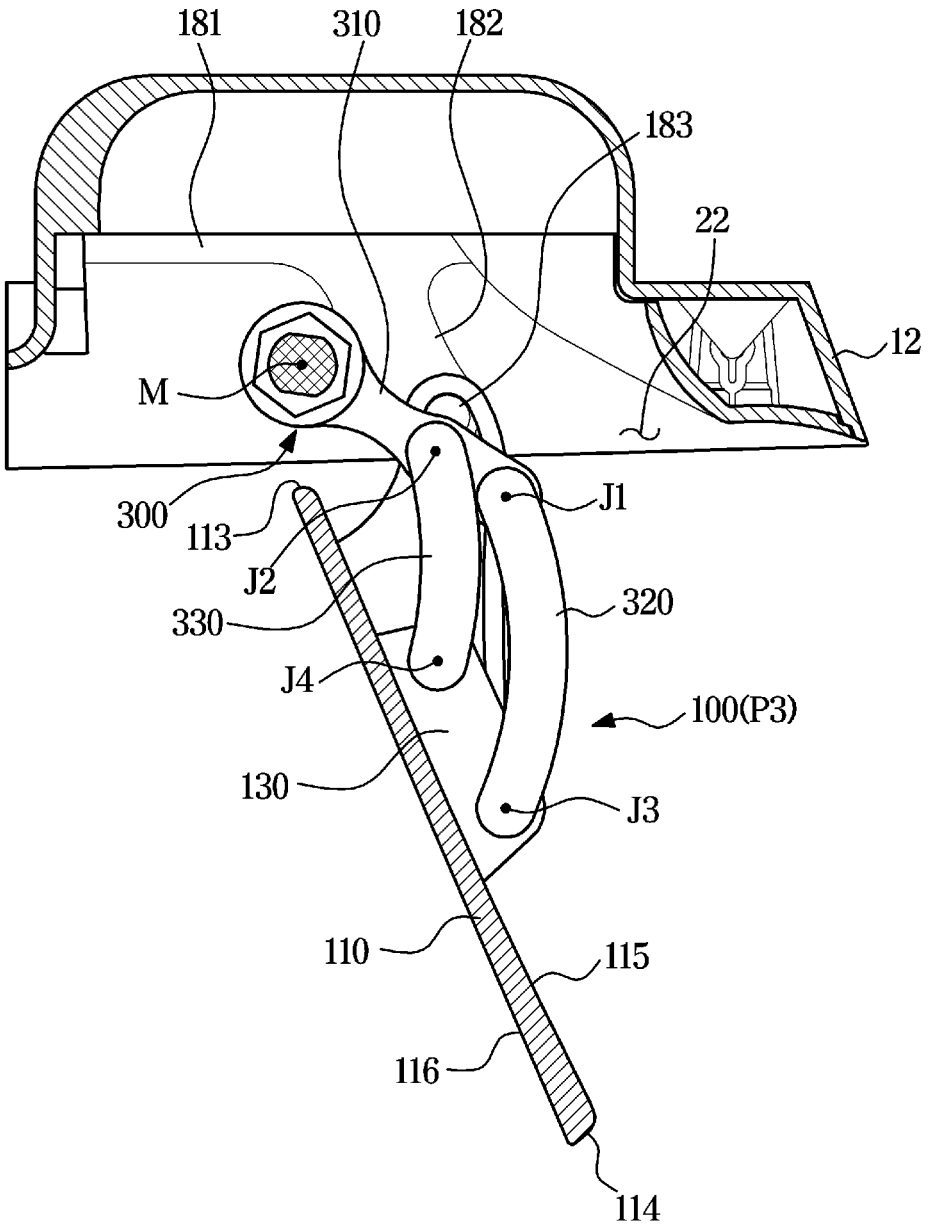
FIG. 14 is a view of the linkage device shown in FIG. 13.
Figure 15:
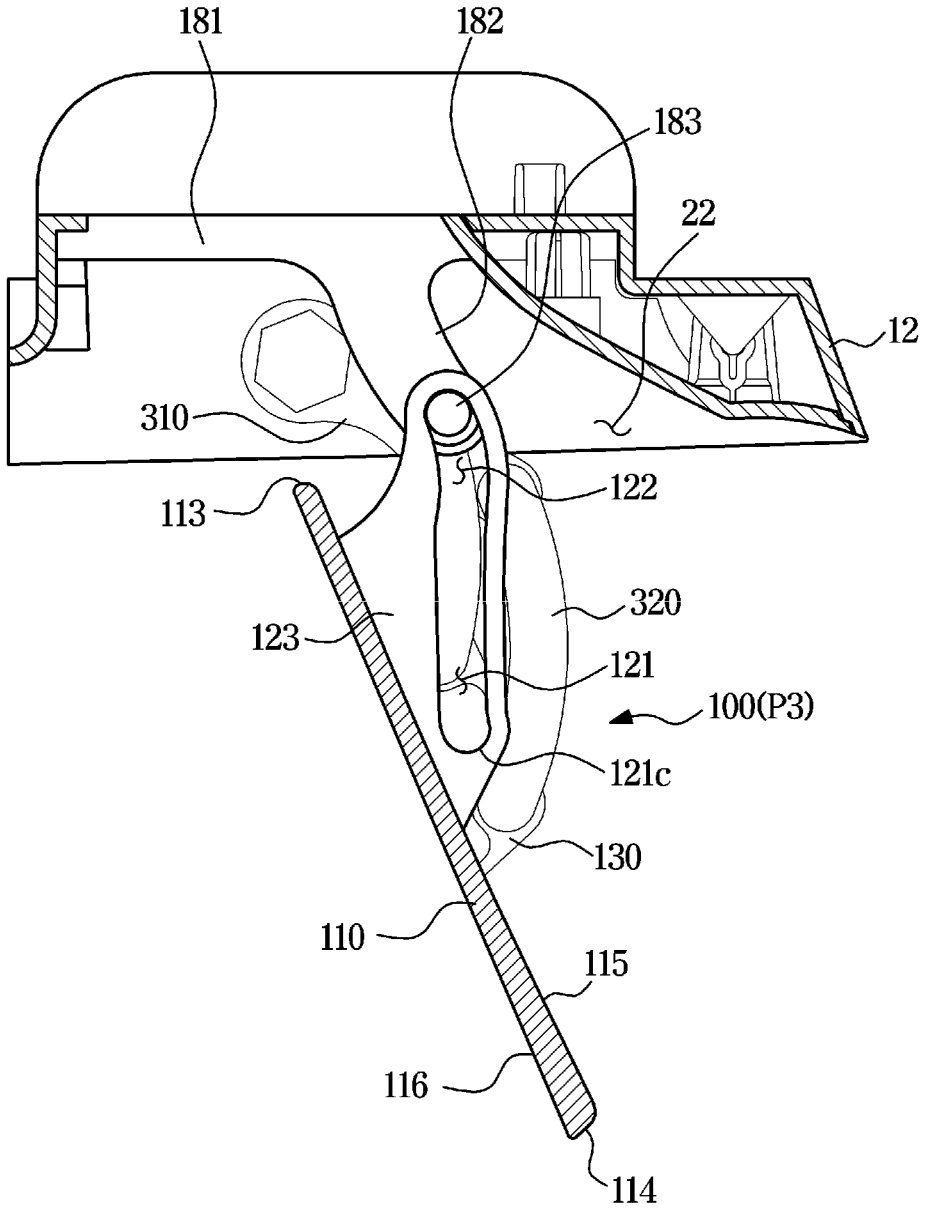
FIG. 15 is a view of the guide rail shown in FIG. 13.

FIG. 7 is a view illustrating a case in which the blade of the air conditioner according to an embodiment are provided at a first position P1. FIG. 8 is a view of the linkage device shown in FIG. 7. FIG. 9 is a view of the guide rail shown in FIG. 7. FIG. 10 is a view illustrating a case in which the blade of the air conditioner according to an embodiment are provided at a second position P2. FIG. 11 is a view of the linkage device shown in FIG. 10. FIG. 12 is a view of the guide rail shown in FIG. 10. FIG. 13 is a view illustrating a case in which the blade of the air conditioner according to an embodiment are provided at a third position P3. FIG. 14 is a view of the linkage device shown in FIG. 13. FIG. 15 is a view of the guide rail shown in FIG. 13.

The blade 100 may be movable between a closed position P1 (see FIGS. 7 to 9) provided to close the outlet 22 and an open position P3 (see FIGS. 13 to 15) provided to open the outlet 22. For example, when the blade 100 is positioned at the open position P3, the blade 100 may be provided to open the outlet 22 to the maximum. The blade 100 may be provided at an intermediate position P2 (see FIGS. 10 to 12) between the closed position P1 and the open position P3. For example, when the blade 100 is positioned at the intermediate position P2, the blade 100 may be provided to open the outlet 22 within a predetermined range.

Hereinafter, the closed position P1 may also be referred to as the first position P1, the intermediate position P2 may also be referred to as the second position P2, and the open position P3 may also be referred to as the third position P3. However, for the first position P1, the second position P2, and the third position P3, the ordinal numbers of "first", "second", and "third" do not define their configuration. For example, the first position P1, the third position P2, and the second position P3 may be defined. For example, the second position P1, the third position P2, and the first position P3 may be defined. For example, the third position P1, the second position P2, and the first position P3 may be defined. However, it is not limited to the above examples, and the first position P1, the second position P2, and the third position P3 may be defined differently.

Referring to FIGS. 7 to 9, the blade 100 may be provided at the first position P1. When the blade 100 is positioned at the first position P1, the blade 100 may close the outlet 22. For example, when the blade 100 is positioned at the first position P1, the blade body 110 may be positioned on an approximately X-Y plane.

When the blade 100 is positioned at the first position P1, the linkage device 300 may be accommodated inside the main body 10. For example, when the blade 100 is positioned at the first position P1, the linkage device 300 may be accommodated inside the outlet panel 12.

When the blade 100 is positioned at the first position P1, the guide protrusion 183 of the main body 10 may be located at an end of the first section 121 of the guide rail 120. For example, when the blade 100 is positioned at the first position P1, the guide protrusion 183 of the main body 10 may be located at a front end of the guide rail 120.

Referring to FIGS. 10 to 12, the blade 100 may be positioned at the second position P2 between the first position P1 and the third position P3. When the blade 100 is positioned at the second position P2, the blade 100 may open the outlet 22 within a predetermined range. For example, the blade 100 may rotate in the first direction R1 from the first position P1 and then be positioned at the second position P2. For example, the blade 100 may rotate in the second direction R2 from the third position P3 and then be positioned at the second position P2.

When the blade 100 is positioned at the second position P2, a portion of the linkage device 300 may be located inside the main body 10 and the remaining portion of the linkage device 300 may be located outside the main body 10. For example, when the blade 100 is positioned at the second position P2, a portion of the linkage device 300 may be located inside the outlet panel 12 and the remaining portion of the linkage device 300 may be located outside the outlet panel 12. For example, when the blade 100 is positioned at the second position P2, the first link 310 may be located inside the main body 10. For example, a portion of the second link 320 and a portion of the third link 330 may be located outside the main body 10.

When the blade 100 is positioned at the second position P2, the guide protrusion 183 of the main body 10 may be arranged to overlap the first section 121 and the second section 122 of the guide rail 120. For example, when the blade 100 is positioned at the second position P2, most of the first section 121 of the guide rail 120 may be located outside the main body 10. For example, when the blade 100 is positioned at the second position P2, most of the second section 122 of the guide rail 120 may be located inside the main body 10.

Referring to FIGS. 13 to 15, the blade 100 may be positioned at the third position P3. When the blade 100 is positioned at the third position P3, the blade 100 may open the outlet 22 to a maximum degree. For example, the degree of opening of the outlet 22 when the blade 100 is positioned at the third position P3 may be greater than that of the outlet 22 when the blade 100 is positioned at the second position P2.

When the blade 100 is positioned at the third position P3, most of the linkage device 300 may be located outside the main body 10. For example, when the blade 100 is positioned at the third position P3, most of the linkage device 300 may be located outside the outlet panel 12. For example, when the blade 100 is positioned at the third position P3, a portion of the first link 310 may be located outside the main body 10. For example, when the blade 100 is positioned at the third position P3, the second link 320 may be located outside the main body 10. For example, when the blade 100 is positioned at the third position P3, most of the third link 330 may be located outside the main body 10.

When the blade 100 is positioned at the third position P3, the guide protrusion 183 of the main body 10 may be located at an end of the second section 122 of the guide rail 120. For example, when the blade 100 is positioned at the third position P3, the guide protrusion 183 of the main body 10 may be located at an rear end of the guide rail 120.

On the other hand, the blade 100 may be provided to enable different driving. The blade 100 may perform at least one of a translational movement or a rotational movement. The blade 100 may perform the translational movement within a predetermined range. The blade 100 may perform the rotational movement within a predetermined range. The blade 100 may perform the translational movement and the rotational movement within a predetermined range.

Figure 16:
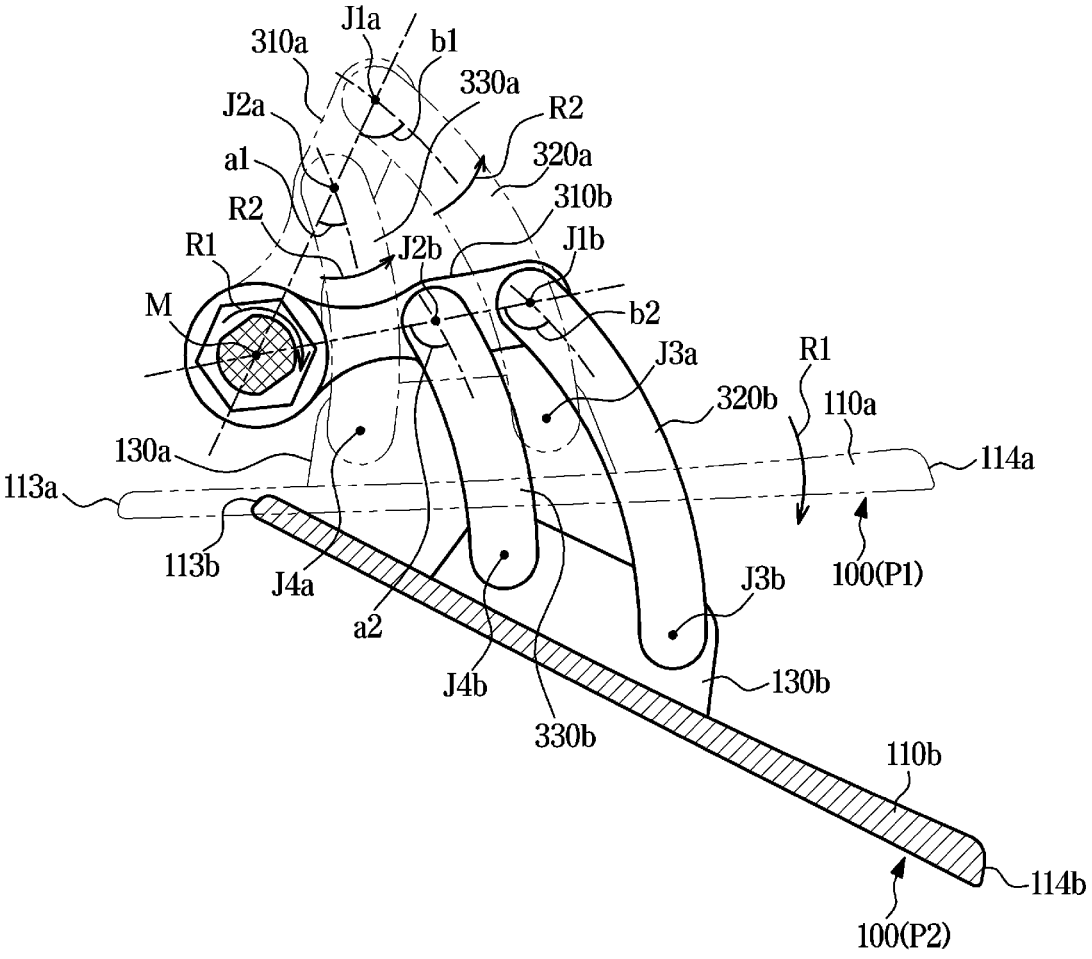
FIG. 16 is a view illustrating the linkage device when the blade of the air conditioner according to an embodiment of the disclosure moves from the first position P1 to the second position P2.
Figure 17:
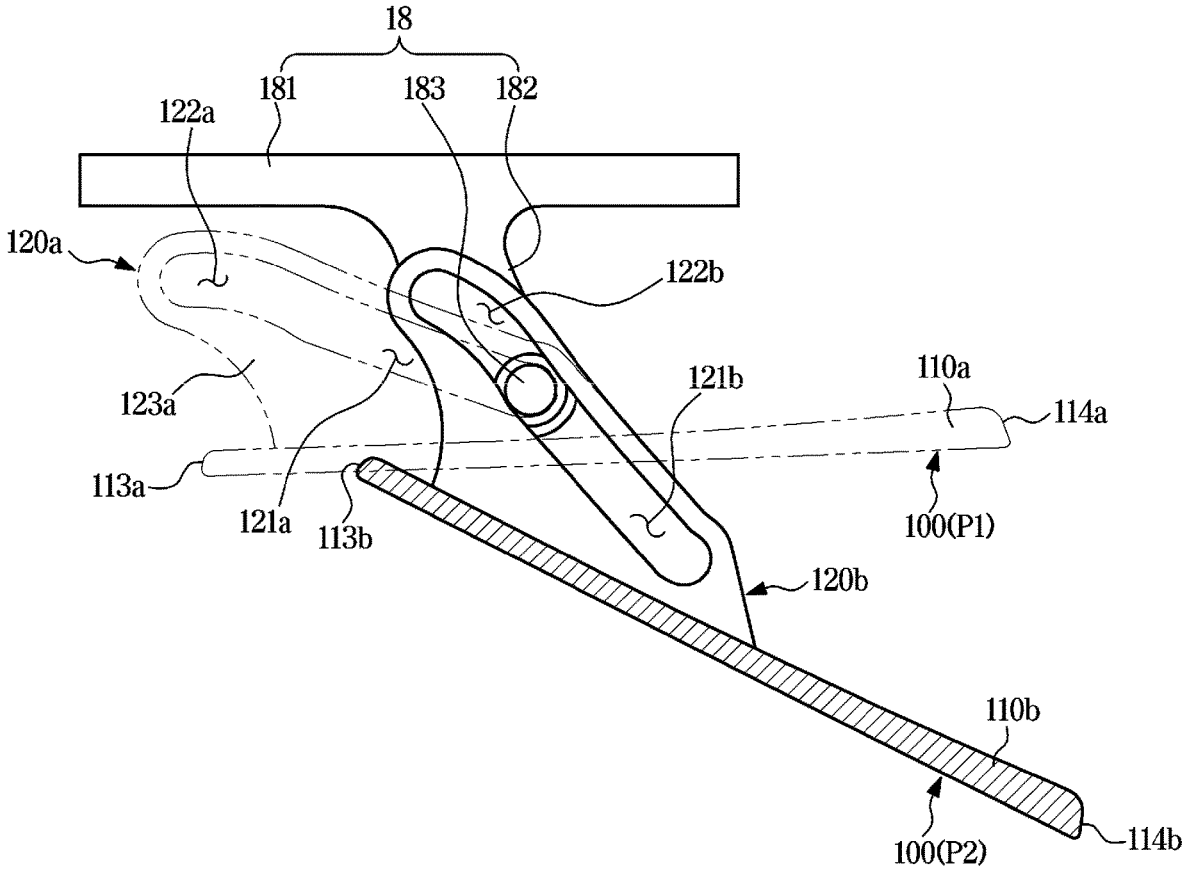
FIG. 17 is a view illustrating the guide rail when the blade of the air conditioner according to an embodiment of the disclosure moves from the first position P1 to the second position P2.

FIG. 16 is a view illustrating the linkage device when the blade of the air conditioner according to an embodiment of the disclosure moves from the first position P1 to the second position P2. FIG. 17 is a view illustrating the guide rail when the blade of the air conditioner according to an embodiment of the disclosure moves from the first position P1 to the second position P2.

Referring to FIGS. 16 and 17, an operation of moving the blade 100 from the first position P1 to the second position P2 will be described.

For ease of description, in FIGS. 16 and 17, to distinguish the position of the blade 100, when the blade 100 is positioned at the first position P1, 'a' is added after the reference numeral of each component of the blade 100. When the blade 100 is positioned at the second position P2, 'b' may be added after the reference numeral of each component of the blade 100. Furthermore, in FIGS. 16 and 17, to distinguish the position of the blade 100, the blade 100 positioned at the first position P1 is indicated by a dash-double dotted line, and the blade 100 positioned at the second position P2 is indicated by a solid line. However, these indications are for reference only.

Referring to FIG. 16, the linkage device 300 may transmit a rotational force of the motor 200 to the blade 100. The linkage device 300 may be provided to rotate in conjunction with the rotation of the motor 200. The blade 100 may be provided to rotate in conjunction with the rotation of the linkage device 300.

The first link 310 may be provided to rotate about the motor shaft 210 of the motor 200. The first link 310 may be provided to rotate in the first direction R1 with respect to the center of rotation M. A position of one end of the first link 310 may be fixed. The other end of the first link 310 may move downward while rotating about one end of the first link 310.

The second link 320 may move downwardly in conjunction with the rotation of the first link 310. For example, the second link 320 may push the blade 100 downward. For example, the second link 320 may rotate in the second direction R2.

For example, as the blade 100 moves from the first position P1 to the second position P2, the first joint J1 may move downwardly. For example, as the blade 100 moves from the first position P1 to the second position P2, the first joint J1 may move forward.

For example, as the blade 100 moves from the first position P1 to the second position P2, the third joint J3 may move downwardly. For example, as the blade 100 moves from the first position P1 to the second position P2, the third joint J3 may move forward.

For example, as the blade 100 moves from the first position P1 to the second position P2, an angle between the first link 310 and the second link 320 may increase. For example, the angle b2 between the first link 310*b* and the second link 320*b* when the blade 100 is positioned at the second position P2 may be greater than the angle b1 between the first link 310*a* and the second link 320*a* when the blade 100 is positioned at the first position P1.

The third link 330 may move downwardly in conjunction with the rotation of the first link 310. For example, the third link 330 may push the blade 100 downward. For example, the third link 330 may rotate in the second direction R2.

For example, as the blade 100 moves from the first position P1 to the second position P2, the second joint J2 may move downwardly. For example, as the blade 100 moves from the first position P1 to the second position P2, the second joint J2 may move forward.

For example, as the blade 100 moves from the first position P1 to the second position P2, the fourth joint J4 may move downwardly. For example, as the blade 100 moves from the first position P1 to the second position P2, the fourth joint J4 may move forward.

For example, as the blade 100 moves from the first position P1 to the second position P2, an angle between the first link 310 and the third link 330 may increase. For example, the angle a2 between the first link 310*b* and the third link 330*b* when the blade 100 is positioned at the second position P2 may be greater than the angle a1 between the first link 310*a* and the third link 330*a* when the blade 100 is positioned at the first position P1.

Referring to FIG. 17, as the blade 100 moves from the first position P1 to the second position P2, the guide rail 120 may guide the translational movement and/or the rotational movement of the blade 100.

As the blade 100 is rotated by the linkage device 300, the guide rail 120 may be provided to slide with respect to the guide protrusion 183 of the main body 10. The guide protrusion 183 of the main body 10 may be fixed. The guide rail 120 may slide to allow the guide protrusion 183 to be positioned in the first section 121. The blade 100 may move along the straight line of the first section 121 of the guide rail 120 while receiving the rotational force of the motor 200 through the linkage device 300. Consequently, the blade 100 may be provided to enable the translational movement and/or the rotational movement with respect to the main body 10. The blade body 100 may be provided to enable a combination of translational movement and rotational movement with respect to the main body 10. The blade 100 may be provided to move forward while rotating with respect to the main body 10 within a predetermined range, but is not limited thereto. The blade 100 may be provided to move forward without rotation with respect to the main body 10 within a predetermined range.

Referring to FIGS. 16 and 17, as the blade 100 moves from the first position P1 to the second position P2, the blade 100 may perform the translational movement and/or the rotational movement.

For example, when the blade 100 moves from the first position P1 to the second position P2, the third side 113 of the blade 100 may move forward. For example, when the blade 100 moves from the first position P1 to the second position P2, the fourth side 114 of the blade 100 may move forward. For example, when the blade 100 moves from the first position P1 to the second position P2, the blade 100 may move away from the mid-panel 13. For example, when the blade 100 moves from the first position P1 to the second position P2, the blade 100 may move away from the inlet panel 11.

For example, the third side 113*b* of the blade 100 when the blade 100 is at the second position P2 may be positioned forward of the third side 113*a* of the blade 100 when the blade 100 is at the first position P1. For example, the third side 113*b* of the blade 100 when the blade 100 is at the second position P2 may be positioned downwardly from the third side 113*a* of the blade 100 when the blade 100 is at the first position P1.

For example, the fourth side 114*b* of the blade 100 when the blade 100 is at the second position P2 may be positioned forwardly and downwardly of the fourth side 114*a* of the blade 100 when the blade 100 is at the first position P1.

When the blade 100 moves from the second position P2 to the first position P1, the above operation may be performed in reverse order. The motor 200 rotates in the second direction R2, and the blade 100 interacts with the rotation of the motor 200 and the linkage device 300 to move from the second position P2 to the first position P1. For example, when the blade 100 moves from the second position P2 to the first position P1, the blade 100 may move backwards. For example, when the blade 100 moves from the second position P2 to the first position P1, the blade 100 may rotate in the second direction R2.

Figure 18:
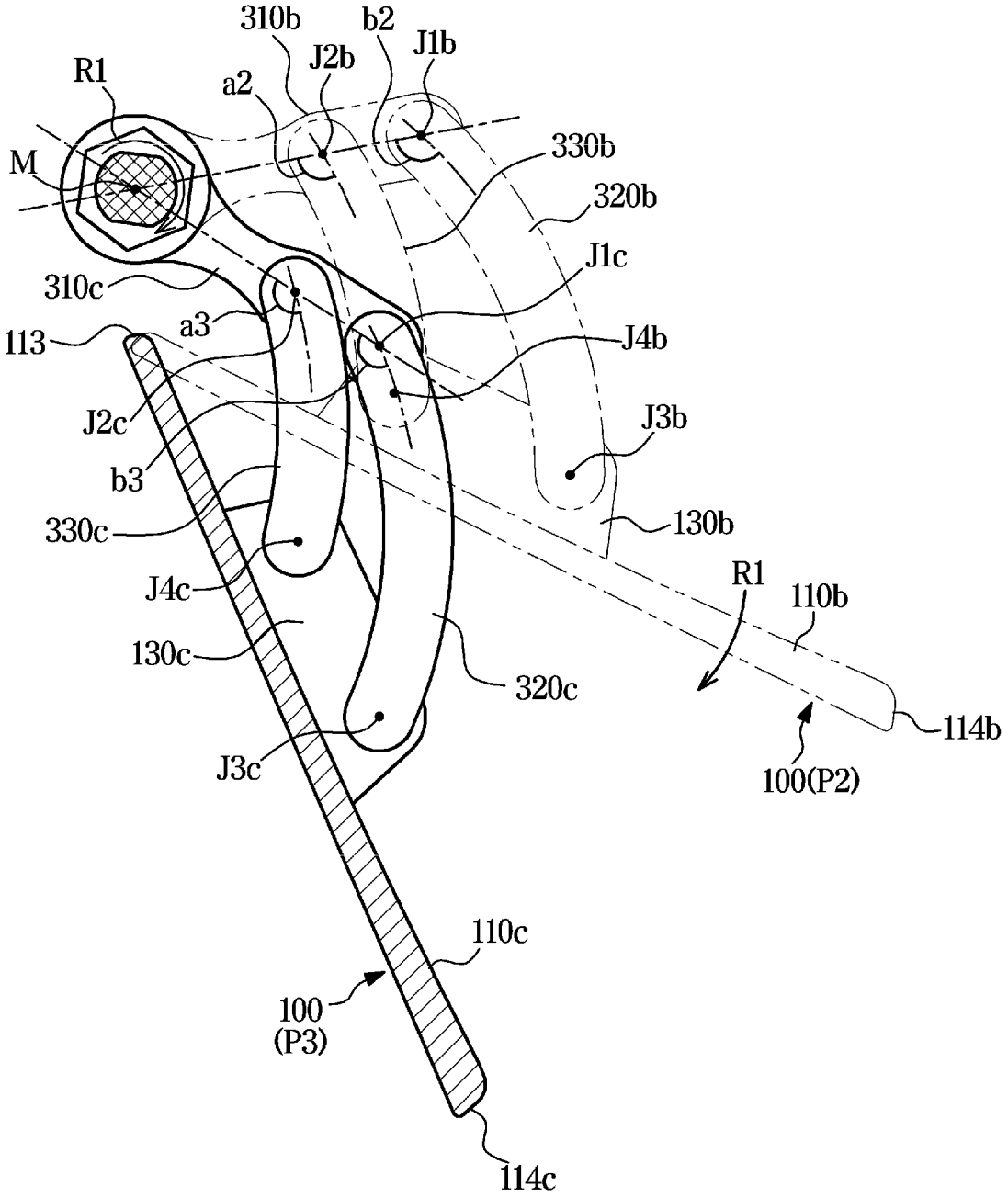
FIG. 18 is a view illustrating the linkage device when the blade of the air conditioner according to an embodiment of the disclosure moves from the second position P2 to the third position P3.
Figure 19:
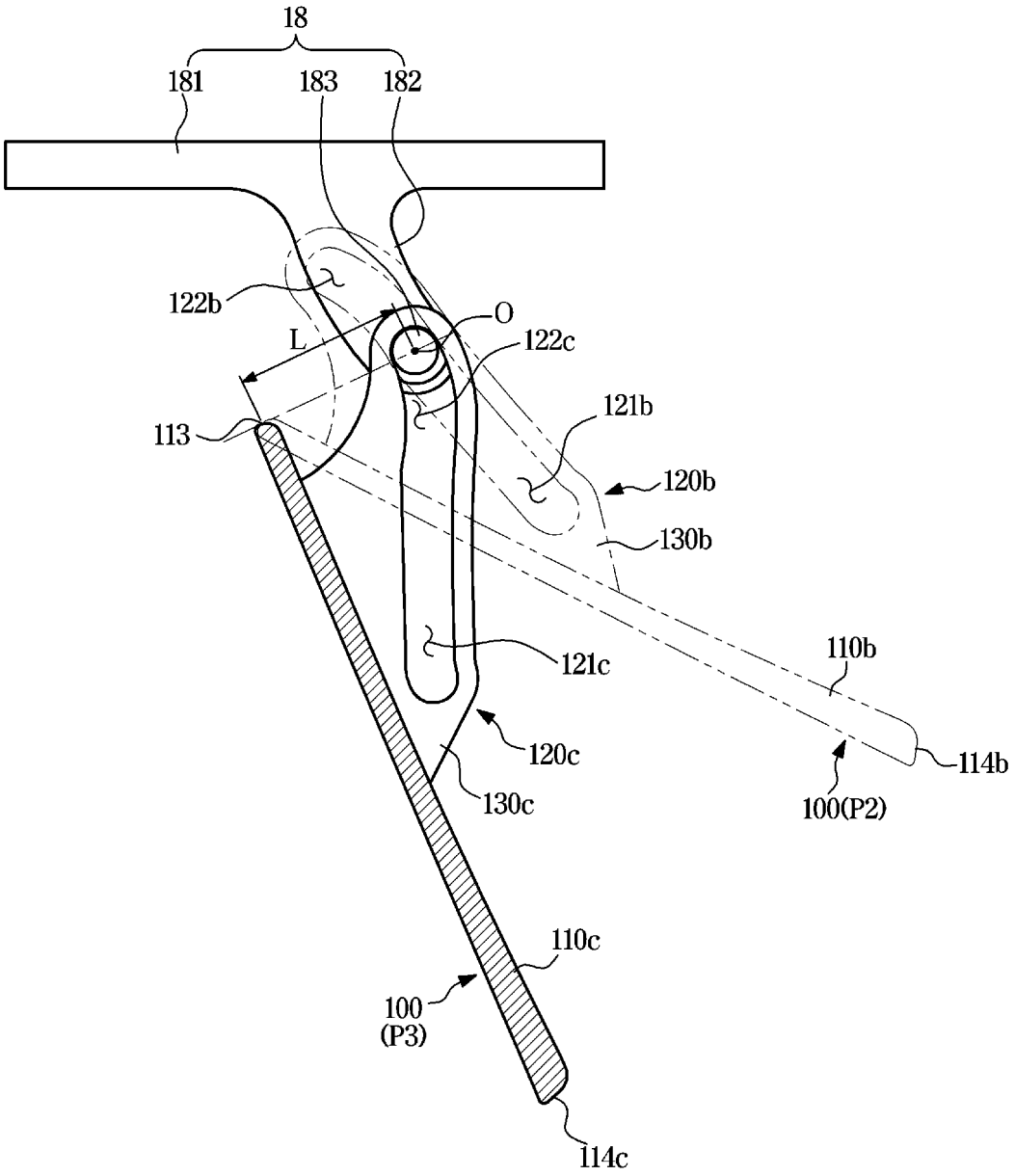
FIG. 19 is a view illustrating the guide rail when the blade of the air conditioner according to an embodiment of the disclosure moves from the second position P2 to the third position P3.

FIG. 18 is a view illustrating the linkage device when the blade of the air conditioner according to an embodiment of the disclosure moves from the second position P2 to the third position P3. FIG. 19 is a view illustrating the guide rail when the blade of the air conditioner according to an embodiment of the disclosure moves from the second position P2 to the third position P3.

Referring to FIGS. 18 and 19, an operation of moving the blade 100 from the second position P2 to the third position P3 will be described.

For ease of description, in FIGS. 18 and 19, to distinguish the position of the blade 100, when the blade 100 is positioned at the second position P2, 'b' is added after the reference numeral of each component of the blade 100. When the blade 100 is positioned at the third position P3, 'c' may be added after the reference numeral of each component of the blade 100. Furthermore, in FIGS. 18 and 19, to distinguish the position of the blade 100, the blade 100 positioned at the second position P2 is indicated by a dash-double dotted line, and the blade 100 positioned at the third position P3 is indicated by a solid line. However, these indications are for reference only.

Referring to FIG. 18, the linkage device 300 may transmit the rotational force of the motor 200 to the blade 100. The linkage device 300 may be provided to rotate in conjunction with the rotation of the motor 200. The blade 100 may be provided to rotate in conjunction with the rotation of the linkage device 300.

The first link 310 may be provided to rotate about the motor shaft 210 of the motor 200. The first link 310 may be provided to rotate in the first direction R1 with respect to the center of rotation M. The position of one end of the first link 310 may be fixed. The other end of the first link 310 may move downward while rotating about one end of the first link 310.

The second link 320 may move downwardly in conjunction with the rotation of the first link 310. For example, the second link 320 may push the blade 100 downward. For example, the second link 320 may move backward in conjunction with the rotation of the first link 310.

For example, as the blade 100 moves from the second position P2 to the third position P3, the first joint J1 may move downwardly. For example, as the blade 100 moves from the second position P2 to the third position P3, the first joint J1 may move backward.

For example, as the blade 100 moves from the second position P2 to the third position P3, the third joint J3 may move downwardly. For example, as the blade 100 moves from the second position P2 to the third position P3, the third joint J3 may move backward.

For example, as the blade 100 moves from the second position P2 to the third position P3, the angle between the first link 310 and the second link 320 may be maintained substantially the same. For example, the angle b3 between the first link 310*c* and the second link 320*c* when the blade 100 is positioned at the third position P3 may be approximately equal to the angle b2 between the first link 310*b* and the second link 320*b* when the blade 100 is positioned at the second position P2, but is not limited thereto. Compared to an amount of angular change between the first link 310 and the second link 320 when the blade 100 moves from the first position P1 to the second position P2, the amount of angular change between the first link 310 and the second link 320 when the blade 100 moves from the second position P2 to the third position P3 may be relatively small or close to zero.

The third link 330 may move downwardly in conjunction with the rotation of the first link 310. For example, the third link 330 may push the blade 100 downward. For example, the third link 330 may move backward in conjunction with the rotation of the first link 310.

For example, as the blade 100 moves from the second position P2 to the third position P3, the second joint J2 may move downwardly. For example, as the blade 100 moves from the second position P2 to the third position P3, the second joint J2 may move backward.

For example, as the blade 100 moves from the second position P2 to the third position P3, the fourth joint J4 may move downwardly. For example, as the blade 100 moves from the second position P2 to the third position P3, the fourth joint J4 may move backward.

For example, as the blade 100 moves from the second position P2 to the third position P3, the angle between the first link 310 and the third link 330 may be maintained substantially the same. For example, the angle a3 between the first link 310*c* and the third link 330*c* when the blade 100 is positioned at the third position P3 may be approximately equal to the angle a2 between the first link 310*b* and the third link 330*b* when the blade 100 is positioned at the second position P2, but is not limited thereto. Compared to an amount of angular change between the first link 310 and the third link 330 when the blade 100 moves from the first position P1 to the second position P2, the amount of angular change between the first link 310 and the third link 330 when the blade 100 moves from the second position P2 to the third position P3 may be relatively small or close to zero.

Referring to FIG. 19, as the blade 100 moves from the second position P2 to the third position P3, the guide rail 120 may guide the rotational movement of the blade 100.

As the blade 100 is rotated by the linkage device 300, the guide rail 120 may be provided to slide with respect to the guide protrusion 183 of the main body 10. The guide protrusion 183 of the main body 10 may be fixed. The guide rail 120 may slide to allow the guide protrusion 183 to be positioned in the second section 122. The blade 100 may move along the curved shape of the second section 122 of the guide rail 120 while receiving the rotational force of the motor 200 through the linkage device 300. The blade 100 may be provided to rotate about the third side 113. Consequently, the blade 100 may be provided to enable the rotational movement with respect to the main body 10. The blade body 100 may be provided to rotate with respect to the main body 10.

Referring to FIGS. 18 and 19, as the blade 100 moves from the second position P2 to the third position P3, the blade 100 may be provided to rotate. For example, as the blade 100 moves from the second position P2 to the third position P3, the blade 100 may rotate about the third side 113.

For example, when the blade 100 moves from the second position P2 to the third position P3, the third side 113 of the blade 100 may not move. For example, when the blade 100 moves from the second position P2 to the third position P3, the position of the third side 113 of the blade 100 may be maintained. For example, when the blade 100 moves from the second position P2 to the third position P3, the fourth side 114 of the blade 100 may be provided to rotate with respect to the third side 113.

For example, the third side 113 of the blade 100 when the blade 100 is at the third position P3 may be positioned at approximately the same position as the third side 113 of the blade 100 when the blade 100 is at the second position P2.

For example, the fourth side 114*c* of the blade 100 when the blade 100 is positioned at the third position P3 may be positioned downwardly and backwardly from the fourth side 114*b* of the blade 100 when the blade 100 is positioned at the second position P2.

For example, when the blade 100 moves from the second position P2 to the third position P3, a distance L from the third side 113 of the blade 100 to the center O of the guide protrusion 183 may be maintained. For example, the distance between the third side 113 and the center O of the guide projection 183 when the blade 100 is at the second position P2 may be the same as the distance between the third side 113 and the center O of the guide projection 183 when the blade 100 is at the third position P3. Accordingly, when moving from the second position P2 to the third position P3, the blade 100 may only perform a rotational movement.

When the blade 100 moves from the third position P3 to the second position P2, the operation described above may be performed in a reverse order. The motor 200 rotates in the second direction R2, and the blade 100 interacts with the rotation of the motor 200 and the linkage device 300 to move from the third position P3 to the second position P2. For example, when the blade 100 moves from the third position P3 to the second position P2, the blade 100 may rotate about the third side 113 in the second direction R2.

Typically, a blade may be driven uniaxially around a motor shaft of a motor. At this time, if the blade has an extended shape in the left and right directions, the blade may interfere with other components during rotation. For example, the blade may interfere with the main body when rotating. For example, a rear portion of the blade may interfere with a guide portion or a mid-panel of the main body. In addition, if the blade has an extended shape in the left and right directions, the rotation range of the blade may be limited to avoid interference between the blade and the main body.

In a contrast, according to the disclosure, the blade 100 may be provided so as not to interfere with the main body 10 during rotation while having a shape extending in the left and right directions. For example, the blade 100 may be provided so as not to interfere with the guide portion 14 or the mid-panel 13 (see FIG. 2). As the blade 100 is rotated by the linkage device 300 having the plurality of joints, the blade 100 is not simply driven to rotate about a single axis. In addition, the blade 100 may be provided to be movable along the shape of the guide rail 120. For example, the blade 100 is interworked with the linkage device 300, causing the blade 100 to rotate and, at the same time, to move along the first section 121 having a straight shape line. For example, when the blade 100 moves from the first position P1 to the second position P2, the blade 100 may move forward. For example, when the blade 100 moves from the first position P1 to the second position P2, the blade 100 may rotate. For example, when the blade 100 moves from the first position P1 to the second position P2, the blade 100 may move in a straight line while rotating (see FIGS. 16 and 17). As a result, the third side 113 of the blade 100 may not interfere with the main body 10 (e.g., the guide portion 14 or the mid-panel 13).

Furthermore, according to the disclosure, the blade 100 may be provided to perform only a rotational movement in a moving state so as not to interfere with the main body 10. The blade 100 may be provided to adjust the degree of opening of the outlet 22 in a moving state so as not to interfere with the main body 10. For example, the blade 100 is interworked with the linkage device 300, causing the blade 100 to rotate and, at the same time, to move along the second section 122 having a curved shape. Accordingly, the blade 100 may be arranged to rotate around one shaft. For example, when the blade 100 moves from the second position P2 to the third position P3, the blade 100 may rotate about the third side 113 (see FIGS. 18 and 19).

Embodiments of the disclosure may provide an air conditioner including a housing, an outlet panel coupled to a lower portion of the housing and forming an outlet, a heat exchanger configured to exchange heat with air introduced into the housing, a fan configured to generate a blowing force within the housing, a motor detachably mounted on the outlet panel, a linkage device, and a blade. The linkage device may include a first link connected to a motor shaft of the motor to rotate in a first direction, a second link rotatably connected to the first link in a second direction opposite to the first direction, and a third link spaced apart from the second link and rotatably connected to the first link in the second direction. The blade may be rotatably connected to the second link and the third link and configured to open and close the outlet by interworking with the rotation of the linkage device.

A length of the second link and a length of the third link may be different.

The outlet panel may include a first body portion provided to cross the outlet, a second body portion extending downwardly from the first body portion, and a guide protrusion protruding from the second body portion. The blade may include a guide rail slidably movable with respect to the guide protrusion and including a first section having a straight line shape and a second section extending from the first section and having a curved shape.

The blade may perform a translational movement and a rotational movement with respect to the outlet panel in response to the guide rail sliding to allow the guide protrusion to be positioned in the first section. The blade may perform a rotational movement with respect to the outlet panel in response to the guide rail sliding to allow the guide protrusion to be positioned in the second section.

In response to the outlet being closed, the blade may cover the outlet panel.

According to various embodiments of the disclosure, an air conditioner may have an aesthetic appearance.

According to various embodiments of the disclosure, an air conditioner may have an increased discharge area.

According to various embodiments of the disclosure, an air conditioner may include blades shaped to extend from side to side.

According to various embodiments of the disclosure, an air conditioner may include blades arranged so as not to interfere with other components.

According to various embodiments of the disclosure, an air conditioner may be compound driven.

While the disclosure has been particularly described with reference to exemplary embodiments, it should be understood by those of skilled in the art that various changes in form and details may be made without departing from the spirit and scope of the disclosure.

What is claimed is:

1. An air conditioner, comprising:
- a main body including:
  - a first side,
  - a second side opposite to the first side,
  - an outlet between the first side and the second side, and
  - a guide protrusion on the outlet; and
- a blade configured to open and close the outlet, the blade including:
  - a blade body extending from the first side to the second side of the main body when the outlet is closed by the blade, and
  - a guide rail on a top surface of the blade body facing the outlet,
- wherein the blade is configured so that:
  - the blade body is rotatable relative to the outlet to adjust a direction of flow of air discharged from the outlet, and
  - the guide rail is supported by the guide protrusion so as to be slidable to guide at least one of a translational movement or a rotational movement of the blade body with respect to the main body during rotation of the blade body.

2. The air conditioner of claim 1, further comprising:
- a motor; and
- a linkage device configured to transmit a rotational force generated by the motor to the blade.

3. The air conditioner of claim 2, wherein
- the linkage device includes:
  - a first link connected to the motor so that the first link is rotatable,
  - a second link connecting the first link and the blade, and
  - a third link connecting the first link and the blade at a position closer to the motor than the second link, the third link having a length shorter than a length of the second link.

4. The air conditioner of claim 3, wherein
the second link and the third link are configured to rotate in opposite directions to a rotation direction of the first link.

5. The air conditioner of claim 3, wherein
the motor includes a motor shaft, and
the first link includes:
a first end connected to the motor shaft, and
a second end configured to rotate about the first end.

6. The air conditioner of claim 2, wherein
the guide rail is disposed more inwardly along the blade body than the linkage device.

7. The air conditioner of claim 1, wherein
the guide rail includes:
a first section inclined downwardly along the direction of flow of the air and having a straight shape, and
a second section extending from an upper portion of the first section and having a curved shape.

8. The air conditioner of claim 7, wherein
the blade body is configured to perform a translational movement and a rotational movement with respect to the main body in response to the guide rail sliding with the guide protrusion in the first section.

9. The air conditioner of claim 7, wherein
the blade body is configured to perform a rotational movement with respect to the main body in response to the guide rail sliding with the guide protrusion in the second section.

10. The air conditioner of claim 7, wherein
the blade is configured to be movable between:
a first position in which the outlet is closed and the guide protrusion is disposed at an end of the first section of the guide rail, and
a second position in which the outlet is open and the guide protrusion is disposed at an end of the second section of the guide rail.

11. The air conditioner of claim 10, wherein
the blade body includes:
a rear portion, and
a front portion opposite to the rear portion, and
in response to the blade moving from the first position to a third position, in which the guide protrusion is arranged to overlap the first section and the second section of the guide rail, the rear portion of the blade body is configured to move forward.

12. The air conditioner of claim 10, wherein
the blade body includes:
a rear portion, and
a front portion opposite to the rear portion, and
in response to the blade moving from a third position, in which the guide protrusion is arranged to overlap the first section and the second section of the guide rail, to the second position, the blade body is configured to rotate about the rear portion.

13. The air conditioner of claim 7, wherein
the second section of the guide rail has a predetermined radius of curvature.

14. The air conditioner of claim 1, wherein
the blade includes:
a plurality of guide rails arranged along a longitudinal direction of the blade body.

15. The air conditioner of claim 1, wherein
the blade body is configured to cover at least a portion of the first side and at least a portion of the second side when the outlet is closed by the blade.

* * * * *